US011008027B2

(12) United States Patent
Morin

(10) Patent No.: US 11,008,027 B2
(45) Date of Patent: May 18, 2021

(54) RAILROAD CAR TRUCK WITH WARP RESTRAINTS

(71) Applicant: Standard Car Truck Company, Rosemont, IL (US)

(72) Inventor: Andrew J. Morin, Mokena, IL (US)

(73) Assignee: Standard Car Truck Company, Rosemont, IL (US)

( * ) Notice: Subject to any disclaimer, the term of this patent is extended or adjusted under 35 U.S.C. 154(b) by 267 days.

(21) Appl. No.: 16/197,772

(22) Filed: Nov. 21, 2018

(65) Prior Publication Data

US 2019/0185030 A1 Jun. 20, 2019

Related U.S. Application Data

(60) Provisional application No. 62/607,065, filed on Dec. 18, 2017.

(51) Int. Cl.
*B61F 5/06* (2006.01)

(52) U.S. Cl.
CPC ..... *B61F 5/06* (2013.01)

(58) Field of Classification Search
CPC ..... B61F 5/00; B61F 5/02; B61F 5/04; B61F 5/06; B61F 5/09; B61F 5/10; B61F 5/16; B61F 5/24; B61F 5/26; B61F 5/38; B61F 5/42; B61F 5/44; B61F 5/50; B61F 5/383; B61F 3/00; B61F 3/08
See application file for complete search history.

(56) References Cited

U.S. PATENT DOCUMENTS 169,663 A * 11/1875 Wells ..... A42C 1/04 223/15
174,232 A * 2/1876 Greenleaf ..... B07B 9/02 209/36
1,414,962 A * 5/1922 Kadel ..... B61F 5/40 105/179
2,696,176 A * 12/1954 Dath ..... B61F 5/122 105/198.2
3,782,294 A * 1/1974 Sundby ..... B61F 5/10 105/190.1
4,244,298 A * 1/1981 Hawthorne ..... B61F 5/122 105/198.4
RE31,008 E 8/1982 Barber
4,363,276 A * 12/1982 Neumann ..... B61F 5/52 105/198.2
4,793,720 A * 12/1988 Merker, Jr. ..... B61F 5/142 384/423

(Continued)

FOREIGN PATENT DOCUMENTS

EP 0614793 A1 9/1994
EP 1556265 B1 4/2006

(Continued)

OTHER PUBLICATIONS

Korean Intellectual Property Office, "International Search Report and Written Opinion" from PCT/US2018/064868 (11 pages), dated Mar. 28, 2019.

*Primary Examiner* — Jason C Smith
(74) *Attorney, Agent, or Firm* — McCoy Russell LLP

(57) ABSTRACT

A railroad car truck including a first side frame, a second side frame, a bolster, and a plurality of warp restraints that are configured to prevent warping of the bolster relative to the side frames.

16 Claims, 14 Drawing Sheets

(56) References Cited

U.S. PATENT DOCUMENTS 4,917,021 A * 4/1990 Murphy ..... B61D 3/182 105/225
5,107,773 A * 4/1992 Daley ..... B61F 5/14 105/185
5,682,822 A * 11/1997 Sunderman ..... B61F 5/142 105/199.3
5,806,435 A * 9/1998 Pitchford ..... B61F 5/14 105/199.3
6,125,767 A * 10/2000 Hawthorne ..... B61F 5/52 105/182.1
6,142,082 A * 11/2000 Burke ..... E05D 15/0665 105/377.09
6,817,301 B1 * 11/2004 Bullock ..... B61F 5/04 105/182.1
7,096,795 B2 * 8/2006 Wike ..... B61F 5/36 105/168
7,174,837 B2 * 2/2007 Berg ..... B61F 5/122 105/197.05
7,665,622 B2 * 2/2010 Anderson ..... B61G 7/12 213/20
2004/0020403 A1 * 2/2004 Forbes ..... B61F 5/30 105/218.1
2007/0169663 A1 * 7/2007 Berg ..... B61F 5/36 105/206.1
2017/0129510 A1 * 5/2017 Golembiewski ..... B61F 5/32
2017/0174232 A1 * 6/2017 Morin ..... B61F 5/38
2019/0168786 A1 * 6/2019 Golembiewski ..... B61F 5/04
2019/0185030 A1 * 6/2019 Morin ..... B61F 3/08
2019/0185031 A1 * 6/2019 Golembiewski ..... B61F 5/122

FOREIGN PATENT DOCUMENTS

KR 1020140026621 A 3/2014
KR 101525082 B1 6/2015
WO 2017112433 A1 6/2017

* cited by examiner

50

RAILROAD CAR TRUCK WITH WARP RESTRAINTS

PRIORITY CLAIM

This application claims priority to and the benefit of U.S. Provisional Patent Application No. 62/607,065, filed Dec. 18, 2017, the entire contents of which are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably or swivelly received by bolster bowls of the two trucks. The trucks rollingly support the car body along railroad tracks or rails. Each truck typically has a three piece truck configuration that includes two spaced apart parallel side frames and a bolster. The side frames extend in the same direction as the tracks or rails, and the bolster extends transversely or laterally (such as perpendicularly) to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks or rails and in the direction of movement of the railroad car on the track or rails in either direction. The "transverse" or "lateral" axis or direction is in a horizontal direction substantially perpendicular to the longitudinal axis and the straight tracks or rails. A truck is considered "square" when its wheels are aligned on parallel rails and the axles are parallel to each other and perpendicular to the side frames. The "leading" side of the truck means the first side of a truck of a railroad car to encounter a turn, and the "trailing" side is opposite of the leading side.

Existing trucks do not fully address the ever increasing and expected future demands for freight railroad car truck performance in the railroad industry. More specifically, while the various current known and commercially available three piece truck configurations meet current Association of American Railroads ("AAR") specifications, enhanced specifications are being developed by the AAR and it is expected that the current three piece truck configurations may not meet these new AAR specifications. These AAR enhanced specifications set forth or codify these continuing and ongoing demands in the railroad industry for improved freight railroad car truck performance to: (a) reduce railroad car component wear and damage such as wheel wear and damage; (b) reduce rolling resistance; (c) reduce fuel consumption; (d) reduce the need for and thus cost of railroad track or rail repair (including reducing the cost of rail and tie maintenance); (e) reduce truck hunting and improve high speed stability ("HSS") for both empty and loaded railroad cars; and (f) improve curving performance for both empty and loaded railroad cars.

Ideally, on straight tracks or straight rails, a three piece truck with parallel side frames and parallel wheel set axles perpendicular to the side frames (i.e., a perfectly "square" truck) rolls without inducing lateral or transverse forces between the wheel tread and the rail. However, at higher speeds, even minor imperfections or perturbations in the tracks or rails or in the equipment can lead to a condition known as "hunting". Hunting refers to a yawing or oscillating lateral movement of the wheel sets along the tracks or rails that causes the railroad car to move side-to-side on the tracks or rails. More than minor imperfections or perturbations in the tracks or rails or in the railroad car equipment or components can lead to greater truck hunting even at lower speeds. Hunting tends to increase wheel wear and damage, increase fuel consumption, increase the need for railroad track or rail repair, and decrease HSS. In certain instances, hunting has also led to derailments, damage to the lading, and damage to the freight railroad cars.

Curved railroad tracks or rails pose a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and the tracks or rails. These wheel forces often cause the wheel set to turn in a direction opposing the curve or turn. On trucks with insufficient rigidity, this can result in a condition variously known as "warping," "lozenging," "parallelogramming," and/or "unsquaring," wherein the side frames remain parallel, but one side frame moves forward with respect to the other side frame. This condition is referred to herein as warping for brevity.

Another known issue relates to various known 3-piece railroad truck suspensions that have side frames with flat rectangular surfaces against which friction wedges are pressed to produce frictional (i.e., Coulomb) damping to control vertical bounces and other oscillatory modes. Normally, significant clearance exists between the side frame's column face and nearby surfaces of the bolster to enable assembly and proper relative motion during use. This clearance is undesirable in that it enables the truck assembly to become warped or change shape from the intended parallel and perpendicular arrangement (i.e., to undergo warping).

Such warping (alone or in combination with hunting) can cause increased wear on the tracks or rails and railroad car truck components or equipment. Such warping (alone or in combination with hunting) also tends to increase rolling resistance that increases railroad car fuel consumption, decreases railroad car efficiency, and increases railroad engine pollution.

Accordingly, there is a need to meet these ongoing demands in the railroad industry for improved freight railroad car truck performance that reduces or minimizes warping.

SUMMARY

Various embodiments of the present disclosure provide a new railroad car, and more particularly a new railroad car having a new railroad car truck with warp restraints that reduces, inhibits, and/or minimizes the above warping related problems.

In various embodiments, the railroad car truck with warp restraints of the present disclosure includes a first side frame, a second side frame, a bolster, and a plurality of warp restraints. In various embodiments, the warp restraints are each positioned to reduce, inhibit, and/or minimize warping of the railroad car truck of the present disclosure.

More specifically, in various embodiments, the railroad car truck of the present disclosure has two such warp restraints including: (1) a first warp restraint at a first end portion of the bolster and at the first side frame; and (2) a second warp restraint at a second end portion of the bolster and at the second side frame. In various embodiments, each warp restraint includes: (a) a torsion tube configured to be supported by and extend transversely through, over, or under the bolster generally in a direction of travel of the railroad car or in the direction of the rails or tracks; (b) a first linkage assembly configured to be connected to the side frame and to one end of the torsion tube; and (c) a second linkage assembly configured to be connected to the side frame and to the opposite end of the torsion tube.

Each of the warp restraints are configured to apply opposing forces to the side frames and bolster to reduce, inhibit, and/or minimize warping. More specifically, when the bolster moves from or out of a square or perpendicular position relative to the side frames (or relative to each respective side frame) to a non-square or warped position, each warp restraint independently and the two warp restraints in combination co-act to apply opposing biasing forces to the bolster and the side frames to cause the bolster and/or side frames to move in the respective opposing direction and return to their normal square, perpendicular, or substantially perpendicular positions relative to each other, and thus act or co-act to reduce, inhibit, and/or minimize warping as further described below.

It should also be appreciated that although the warp restraints of the present disclosure are not primarily intended to produce resistance against other directional movements of the bolster relative to the side frames, in various circumstances and embodiments, the warp restraints of the present disclosure can act or co-act to permit certain directional movements and act or co-act to reduce, inhibit, and/or minimize certain other directional movements alone or in combination with other components of the railroad car truck (such as friction wedges that provide vertical dampening or gibs that provide lateral restraint).

It should be appreciated that that warp restraints of the present disclosure are in addition to the various other conventional components of a conventional railroad car truck.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
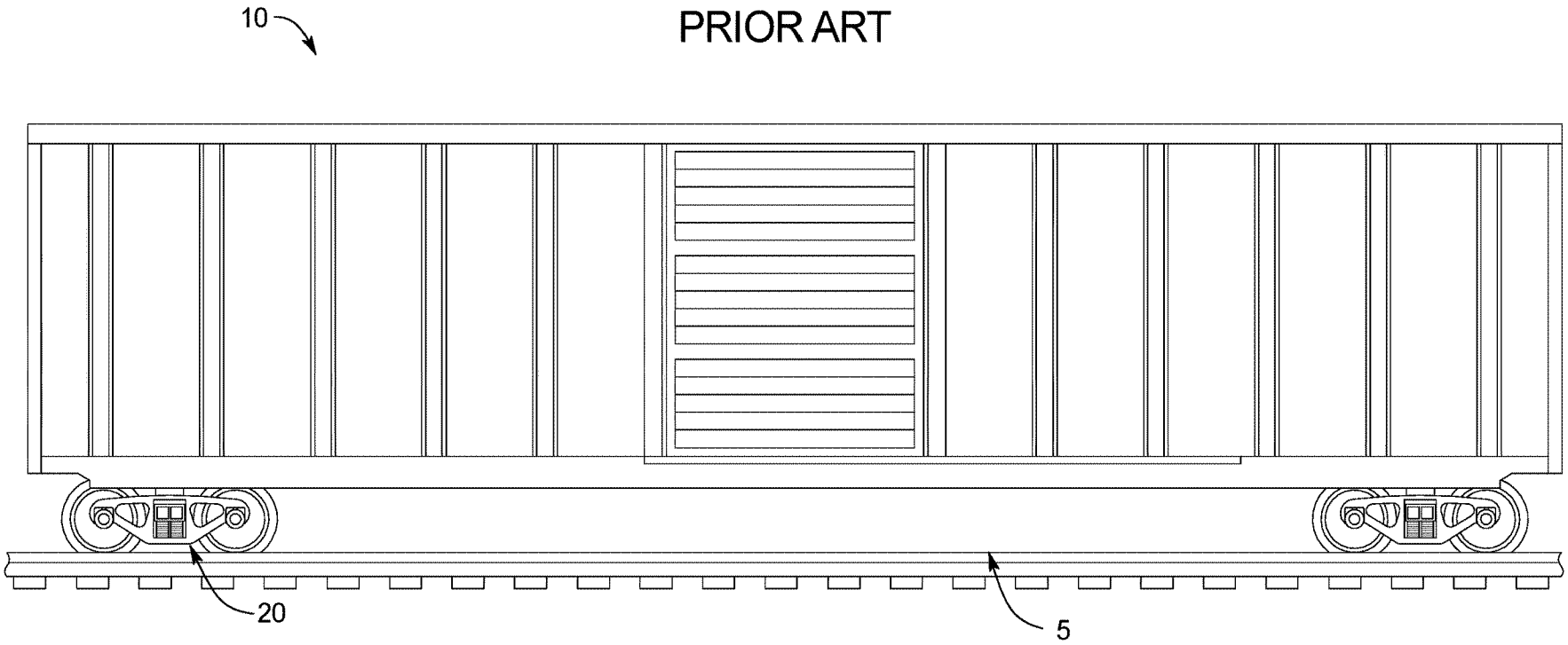
FIG. 1 PRIOR ART
FIG. 1 is a side view of a conventional freight railroad car positioned on conventional railroad tracks.
Figure 2:
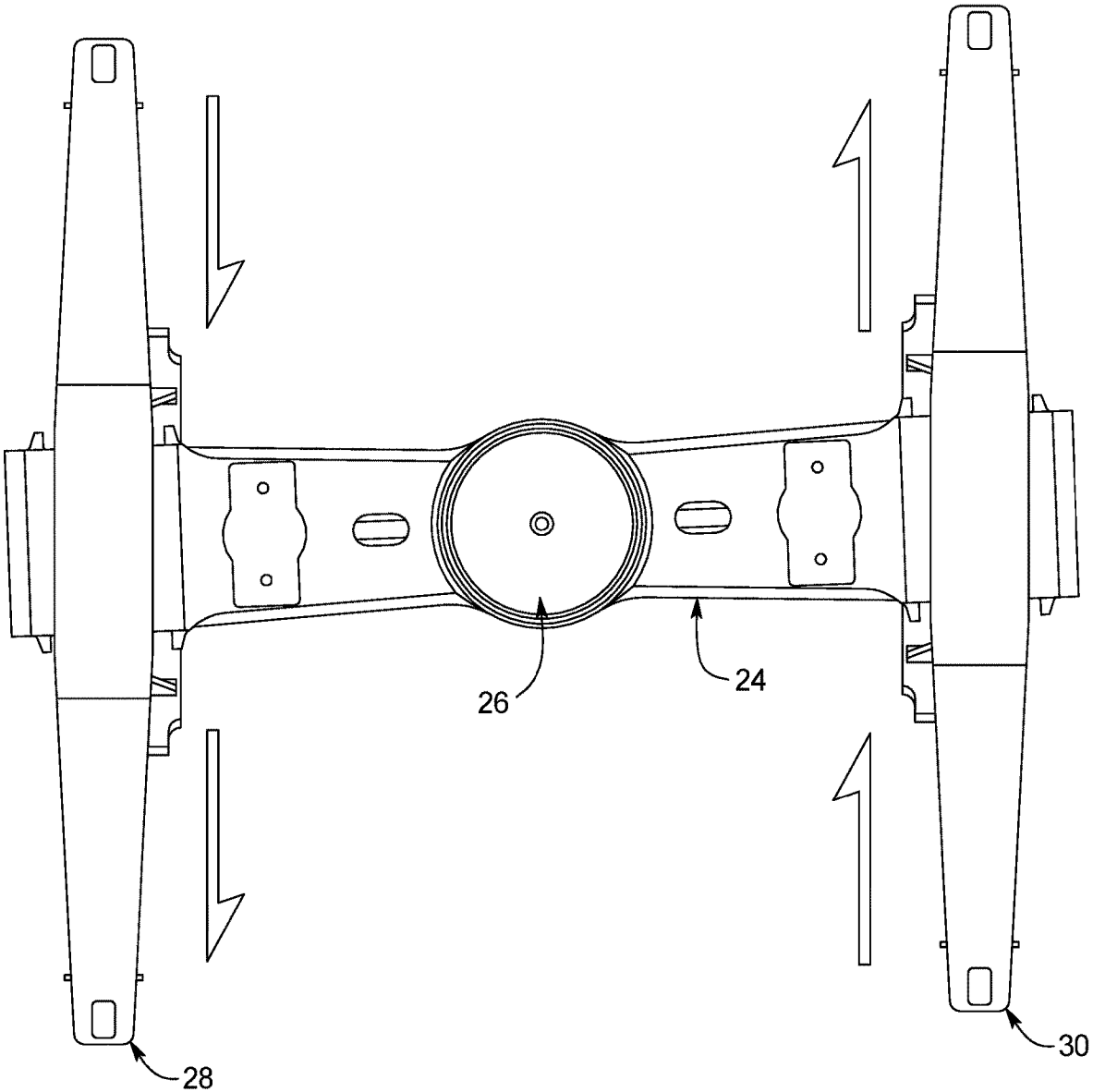
FIG. 2 PRIOR ART
FIG. 2 is a top view of a bolster and two side frames of a conventional freight railroad car truck, and illustrating the bolster in a warped condition relative to the two side frames.

Referring now to the drawings and particularly to FIGS. 1 and 2, a conventional railroad car truck that is generally indicated by numeral 20 is shown with respect to freight railroad car 10 configured to roll along railroad tracks or rails 5. The conventional truck 20 includes a bolster 24, a bolster bowl 26 on the bolster 24, a first side frame 28, and a second side frame 30. Generally, the bolster 24 extends transversely to the direction of the railroad tracks or rails 5, and the side frames 28 and 30 extend longitudinally in the same direction as the railroad tracks or rails 5. As indicated by the arrows in FIG. 2, the side frames 28 and 30 are subject to warping where the side frames 28 and 30 remain generally parallel, but one side frame (such as side frame 28) moves forward with respect to the other side frame (such as side frame 30). When this occurs, the bolster 24 is not square with either of the side frames 28 or 30 and results in the above described problems.

1st Example Embodiment

Referring now to FIGS. 3A, 3B, 4, 5, 6, and 7, one example embodiment of a railroad car truck with the warp restraints of the present disclosure is shown and generally indicated by numeral 50.

In this illustrated example embodiment of the present disclosure, the railroad car truck with warp restraints 50 includes a bolster 40, a bolster bowl 42 on the bolster 40, a first side frame 60, and a second side frame 80. Generally, the bolster 40 is configured to extend transversely to the direction of the railroad tracks or rails (not shown in FIG. 3A, 3B, 4, 5, 6, or 7), and the side frames 60 and 80 are configured to extend longitudinally in the same direction as the railroad tracks (not shown in FIG. 3A, 3B, 4, 5, 6, or 7). The side frame 60 includes: (a) a longitudinally extending body 62; and (b) two downwardly extending pedestal jaws (including a first pedestal jaw 64 and a second pedestal jaw 66) on opposite sides of the center opening 68 in the body 62 of the side frame 60. The body 62 includes a first side wall, a top wall, a second side wall, and a bottom wall that generally define the center opening 68. The side frame 80 includes: (a) a longitudinally extending body 82; and (b) two downwardly extending pedestal jaws (including a first pedestal jaw 84 and a second pedestal jaw 86) on opposite sides of the center opening 88 in the body 82 of the side frame 80. The body 82 includes a first side wall, a top wall, a second side wall, and a bottom wall that generally define the center opening 88.

In this illustrated example embodiment of the present disclosure, as best shown in FIGS. 3A, 3B, 4, 5, 6, and 7, the railroad car truck with warp restraints 50 includes: (1) a first warp restraint 100; and (2) a second warp restraint 1100. The first warp restraint 100 is connected to the side frame 60 and a first end of the bolster 40. The second warp restraint 1100 is connected to the side frame 80 and an opposing second end of the bolster 40.

In this illustrated example embodiment, the warp restraint 100 generally includes: (a) a first torsion tube or member 200 configured to be connected to and extend transversely through the first end of the bolster 40 in a direction of travel of the railroad car or in the direction of the rails or tracks; (b) torsion tube bolster connectors 280 and 290; (c) a first linkage assembly 300 configured to be connected to the side frame 60 and connected to a first end 220 of the torsion tube 200; and (d) a second linkage assembly 400 configured to be connected to the side frame 60 and connected to the opposite end 240 of the torsion tube 200.

In this illustrated embodiment, the warp restraint 1100 likewise generally includes: (a) a second torsion tube or member 1200 configured to be connected to and extend transversely through the second end of the bolster 40 in a direction of travel of the railroad car or in a direction of the rails or tracks; (b) torsion tube bolster connectors 1280 and 1290; (c) a first linkage assembly 1300 configured to be connected to the side frame 80 and connected to a first end 1220 of the torsion tube 1200; and (d) a second linkage assembly 1400 configured to be connected to the side frame 80 and connected to the opposite end 1240 of the torsion tube 1200.

It should be appreciated that each of the warp restraints 100 and 1100 in this illustrated example embodiment and in various other embodiments of the present disclosure are identical or substantially identical (except for their respective positioning and arrangement with the side frames and the bolster). Since in this illustrated example embodiment, the first warp restraint 100 and the second warp restraint 1100 are mirror images of each other, only first warp restraint 100 will be discussed in detail herein for brevity. It should be appreciated that the warp restraints do not need to be mirror images of each other or identical or substantially identical in accordance with the present disclosure. It should also be appreciated that the warp restraint of the present disclosure can vary based on the respective positions and connections to or formations with the respective side frames and the bolster.

Turning now to warp restraint 100, as best shown in FIGS. 4, 5, 6, and 7, the torsion tube 200 includes an elongated body 210 having a first or rear end 220, an opposing second or front end 240, and an intermediate section 260 connecting the rear end 220 and the front end 220. In this illustrated example embodiment, the first or rear end 220 is integrally connected to or formed with the intermediate section 260, and the second or front end 240 is also integrally connected to or formed with the intermediate section 260. In this illustrated example embodiment, the torsion tube 200 is made from a suitable steel or other suitable high-strength material. It should be appreciated that the torsion tube can be made from other suitable materials and in other suitable sizes and configurations.

The torsion tube 200 extends transversely relative to the bolster such as extending through the first end of the bolster 40 in a forward to rearward direction. In other words, the torsion tube 200 generally extends relative to the bolster in the direction of travel of the truck 50 and the entire railroad car. In this illustrated example embodiment, the torsion tube 200 extends through aligned side-bearing access holes or openings in the front and rear walls of the first end of the bolster 40. Such openings are partially shown in FIG. 4. It should be appreciated that these opening already exists in many known bolsters, which facilitates easy retrofitting of such bolsters with the warp restraints of the present disclosure. It should also be appreciated that the torque tubes of the present disclosure can be positioned through other suitable openings in the bolster in accordance with the present disclosure, or above or below the bolster and suitably connected thereto. In this illustrated example embodiment, the torsion tube 200 is partially held in place by the walls of the bolster 40 that define these respective openings.

In this illustrated example embodiment, the torsion tube 200 is also partially held in place by torsion tube bolster connectors 280 and 290.

In this illustrated example embodiment, torsion tube bolster connector 280 generally includes a somewhat triangular body 282 configured to be mounted to the outer surface of the rear side wall of the bolster 40 by suitable fasteners (not shown). The body 282 of the torsion tube bolster connector 280 includes an interior surface 284 defining a cylindrical or substantially cylindrical opening through which the torsion tube 200 extends. The body 282 of the torsion tube bolster connector 280 is configured to hold a part of the intermediate section 260 of the torsion tube 200 adjacent to the first or rear end 220 of the torsion tube 200. The body 282 of the torsion tube bolster connector 280 is configured to enable the intermediate section 260 of the torsion tube 200 to move rotate or twist relative to the body 282 of the torsion tube bolster connector 280. In this illustrated example embodiment, the torsion tube bolster connector 280 is made from suitable bearing material such as but not limited to a UHMWPE, bronze, steel with low-friction inserts, or hardened steel; however, it should be appreciated that the torsion tube bolster connector 280 can be made from other suitable materials and in other suitable shapes and configurations.

Likewise, in this illustrated example embodiment, torsion tube bolster connector 290 generally includes a somewhat triangular body 292 configured to be mounted to the outer surface of the front side wall of the bolster 40 by suitable fasteners (not shown). The body 292 of the torsion tube bolster connector 290 includes an interior surface 294 defining a cylindrical or substantially cylindrical opening through which the torsion tube 200 extends. The body 292 of the torsion tube bolster connector 290 is configured to hold a part of the intermediate section 260 of the torsion tube 200 adjacent to the second or front end 240 of the torsion tube 200. The body 292 of the torsion tube bolster connector 290 is configured to enable the intermediate section 260 of the torsion tube 200 to move rotate or twist relative to the body 292 of the torsion tube bolster connector 290. In this illustrated example embodiment, the torsion tube bolster connector 290 is made from suitable bearing material such as but not limited to a UHMWPE, bronze, steel with low-friction inserts, or hardened steel; however, it should be appreciated that the torsion tube bolster connector 290 can be made from other suitable materials and in other suitable shapes and configurations.

The first or rear end 220 of the torsion tube 200 has a first engagement shape, structure, or mechanism to facilitate operable coupling or connection to the first linkage assembly 300 such that: (a) rotational movement of the first or rear end 220 of the torsion tube 200 causes upward or downward or lateral movement of a lever arm 320 of the first linkage assembly 300; and (b) upward or downward or lateral movement of the lever arm 320 of the first linkage assembly 300 causes rotational movement of the first or rear end 220 of the torsion tube 200. In this illustrated example embodiment, the first or rear end 220 has a generally rectangular shape (in cross-section) that functions as a whole or as part of the first engagement shape, structure, or mechanism.

Likewise, the second or front end 240 of the torsion tube 200 has a second engagement shape, structure, or mechanism to facilitate operable coupling or connection to the first linkage assembly 400 such that: (a) rotational movement of the second or front end 240 causes upward or downward movement of a lever arm 420 of the second linkage assembly 400; and (b) upward or downward or lateral movement of the lever arm 420 of the second linkage assembly 400 causes rotational movement of the second or front end 240. In this illustrated example embodiment, the second or front end 240 has a generally rectangular shape (in cross-section) that functions as a whole or as part of the second engagement shape, structure or mechanism.

The first or rear linkage 300 generally includes: (a) a side frame bracket 310 fixedly connected to the side frame 60; (b) the lever arm 320 operably coupled or connected to the first or rear end 220 of the torsion tube 200 as described above; and (c) a connecting arm assembly 350 operably coupled or connected to the side frame bracket 310 and operably coupled or connected to the lever arm 320. In this illustrated example embodiment, the side frame bracket 310 is made from steel, the lever arm 320 is made from steel, and the connecting arm assembly 350 is made from steel. It should be appreciated that one or more of these components can be made from other suitable materials.

The side frame bracket 310 is configured to be fixedly attached to the side frame 60 such as by welding. The side frame bracket 310 includes a side frame mounting base or portion 312 and an attachment arm 314 extending from the mounting base 312. The attachment arm 314 includes a cylindrical or substantially cylindrical inner surface 316 that defines an attachment pin receipt opening. It should be appreciated that these attachment pin connections also may include suitable bearings or bearing material.

The lever arm 320 includes a body having a lower end 322 that includes an inner surface that defines a torsion bar receiving opening 324. In this example embodiment, the inner surface and the torsion bar receiving opening 324 correspond to the first engagement shape, structure, or mechanism of the first or rear end 220 of the torsion tube 200 to facilitate operable coupling or connection to the torsion bar 200 such that: (a) rotational movement of the first or rear end 220 of the torsion tube 200 causes upward or downward or lateral movement of the lever arm 320; and (b) upward or downward or lateral movement of the lever arm 320 causes rotational movement of the first or rear end 220 of the torsion tube 200. In this illustrated example embodiment, inner surface that defines the torsion bar receiving opening 324 has a generally rectangular shape (in cross-section). The body of the lever arm 320 also includes an upper end 326 that includes an inner surface that defines a pivot pin receipt opening 328 for facilitating attachment to the connecting arm assembly 350.

The connecting arm assembly 350 includes: (a) a first or rear connecting arm or member 380; (b) a second or front connecting arm or member 390; (c) a first pivot pin 360; and (d) a second pivot pin 370.

The first or rear connecting arm or member 380 includes an elongated body having: (a) a first end that functions as a lever arm coupler 382; (b) a second opposing end that functions as a side frame bracket coupler 386; and (c) an intermediate section that functions as a connecting member 385 connecting the first end or lever arm coupler 382 to the second end or side frame bracket coupler 386. The first end that functions as a lever arm coupler 382 includes an inner surface 384 that defines a first attachment pin receipt opening in the first or rear connecting arm or member 380. The second end that functions as a side frame bracket coupler 386 includes an inner surface 388 that defines a second attachment pin receipt opening in the first or rear connecting arm or member 380.

Likewise, the second or front connecting arm or member 390 includes an elongated body having: (a) a first end that functions as a lever arm coupler 392; (b) a second opposing end that functions as a side frame bracket coupler 396; and (c) an intermediate section that functions as a connecting member 395 connecting the first end or lever arm coupler 392 to the second end or side frame bracket coupler 396. The first end that functions as a lever arm coupler 392 includes an inner surface 394 that defines a first attachment pin receipt opening in the second or front connecting arm or member 390. The second end that functions as a side frame bracket coupler 396 includes an inner surface 398 that defines a second attachment pin receipt opening in the second or front connecting arm or member 380.

The first pivot pin 360 of the connecting arm assembly 350 pivotally connects the side frame bracket coupler 386 of the first or rear connecting arm or member 380 to the side frame bracket 310. The first pivot pin 360 of the connecting arm assembly 350 also pivotally connects the side frame bracket coupler 396 of the second or front connecting arm or member 390 to the side frame bracket 310. Although not shown, a suitable securing member can be employed to hold the first pivot pin 360 to the side frame bracket coupler 386 of the first or rear connecting arm or member 380 and to the side frame bracket coupler 396 of the second or front connecting arm or member 390. The first or rear connecting arm or member 380 and the second or front connecting arm or member 390 are thus pivotally connected by the first pivot pin 360 to the side frame bracket 310.

The second pivot pin 370 of the connecting arm assembly 350 pivotally connects the lever arm coupler 382 of the first or rear connecting arm or member 380 to the lever arm 320. The first pivot pin 360 of the connecting arm assembly 350 also pivotally connects the lever arm coupler 392 of the second or front connecting arm or member 390 to the lever arm 320. Although not shown, a suitable securing member can be employed to hold the second pivot pin 370 to the lever arm coupler 382 of the first or rear connecting arm or member 380 and to the lever arm coupler 392 of the second or front connecting arm or member 390. The first or rear connecting arm or member 380 and the second or front connecting arm or member 390 are thus pivotally connected by the second pivot pin 370 to the lever arm 320.

Likewise, the second or front linkage 400 generally includes: (a) a side frame bracket 410 fixedly connected to the side frame 60; (b) the lever arm 420 operably coupled or connected to the second or front end 240 of the torsion tube 200, as described above; and (c) a connecting arm assembly 450 operably coupled or connected to the side frame bracket 410 and operably coupled or connected to the lever arm 420. In this illustrated example embodiment, the side frame bracket 410 is made from steel, the lever arm 420 is made from steel, and the connecting arm assembly 450 is made from steel. It should be appreciated that one or more of these components can be made from other suitable materials.

The side frame bracket 410 is configured to be fixedly attached to the side frame 60 such as by welding. The side frame bracket 410 includes a side frame mounting base or portion 412 and an attachment arm 414 extending from the mounting base 412. The attachment arm 414 includes a cylindrical or substantially cylindrical inner surface 416 that defines an attachment pin receipt opening.

The lever arm 420 includes a body having a lower end 422 that includes an inner surface that defines a torsion bar receiving opening 424. In this example embodiment, the inner surface and the torsion bar receiving opening 424 correspond to the second engagement shape, structure, or mechanism of the second or front end 240 of the torsion tube 200 to facilitate operable coupling or connection to the torsion bar 200 such that: (a) rotational movement of the second or front end 240 of the torsion tube 200 causes upward or downward or lateral movement of the lever arm 420; and (b) upward or downward or lateral movement of the lever arm 420 causes rotational movement of the second or front end 240 of the torsion tube 200. In this illustrated example embodiment, inner surface that defines the torsion bar receiving opening 424 has a generally rectangular shape (in cross-section). The body of the lever arm 420 also includes an upper end 426 that includes an inner surface that defines a pivot pin receipt opening 428 for facilitating attachment to the connecting arm assembly 450.

The connecting arm assembly 450 includes: (a) a first or rear connecting arm or member 480; (b) a second or front connecting arm or member 490; (c) a first pivot pin 460; and (d) a second pivot pin 470.

The first or rear connecting arm or member 480 includes an elongated body having: (a) a first end that functions as a lever arm coupler 482; (b) a second opposing end that functions as a side frame bracket coupler 486; and (c) an intermediate section that functions as a connecting member 485 connecting the first end or lever arm coupler 482 to the second end or side frame bracket coupler 486. The first end that functions as a lever arm coupler 482 includes an inner surface 484 that defines a first attachment pin receipt opening in the first or rear connecting arm or member 480. The second end that functions as a side frame bracket coupler 486 includes an inner surface 488 that defines a second attachment pin receipt opening in the first or rear connecting arm or member 480.

Likewise, the second or front connecting arm or member 490 includes an elongated body having: (a) a first end that functions as a lever arm coupler 492; (b) a second opposing end that functions as a side frame bracket coupler 496; and (c) an intermediate section that functions as a connecting member 495 connecting the first end or lever arm coupler 492 to the second end or side frame bracket coupler 496. The first end that functions as a lever arm coupler 492 includes an inner surface 494 that defines a first attachment pin receipt opening in the second or front connecting arm or member 490. The second end that functions as a side frame bracket coupler 496 includes an inner surface 498 that defines a second attachment pin receipt opening in the second or front connecting arm or member 480.

The first pivot pin 460 of the connecting arm assembly 450 pivotally connects the side frame bracket coupler 486 of the first or rear connecting arm or member 480 to the side frame bracket 410. The first pivot pin 460 of the connecting arm assembly 450 also pivotally connects the side frame bracket coupler 496 of the second or front connecting arm or member 490 to the side frame bracket 410. Although not shown, a suitable securing member can be employed to hold the first pivot pin 460 to the side frame bracket coupler 486 of the first or rear connecting arm or member 480 and to the side frame bracket coupler 496 of the second or front connecting arm or member 490. The first or rear connecting arm or member 480 and the second or front connecting arm or member 390 are thus pivotally connected by the first pivot pin 460 to the side frame bracket 410.

The second pivot pin 470 of the connecting arm assembly 450 pivotally connects the lever arm coupler 482 of the first or rear connecting arm or member 480 to the lever arm 420. The first pivot pin 460 of the connecting arm assembly 450 also pivotally connects the lever arm coupler 492 of the second or front connecting arm or member 490 to the lever arm 420. Although not shown, a suitable securing member can be employed to hold the second pivot pin 470 to the lever arm coupler 482 of the first or rear connecting arm or member 480 and to the lever arm coupler 492 of the second or front connecting arm or member 490. The first or rear connecting arm or member 480 and the second or front connecting arm or member 490 are thus pivotally connected by the second pivot pin 470 to the lever arm 420.

It should be appreciated from the above, that when the bolster 40 moves out of the square position relative to the side frame 60, the movement of the side frames 60 relative to the bolster 40 will generally cause the one of or both of the first linkage assembly 300 and the second linkage assembly 400 to cause one or more of the ends of the torque tube 200 to twist. When or after being twisted, the torque tube 200 will want to return to its normal shape or resting position, and thus the torque tube 200 will cause one or more of those cause one or more of those twisted ends of the torque tube 200 to twist back toward their original or resting shape. This force will in turn cause opposite movements of the lever arms 320 and 420, which will in turn causes opposite movements of the connecting arm assemblies 350 and 450, which will in turn exert opposite forces on the side frames brackets and side frames. Thus, when warping starts to occur, each lever arm will apply twisting forces to the torsion tube 200, the material of the tube will respond elastically and thus resist or counter act the warping forces.

It should thus be appreciated that these components, their positions, and the relative connections and couplings (including the sets of pivotal connections) of the warp restraint 100: (a) provide and limit the respective movements of each component relative to each other component; (b) co-act to provide a linkage from the side frame 60 to the first or rear end 220 of the torque tube 200 and to the second or front end 240 of the torque tube 200; and (c) result in applying opposing forces to the side frame 60 and bolster 40 to reduce, inhibit, and/or minimize warping.

Figure 3A:
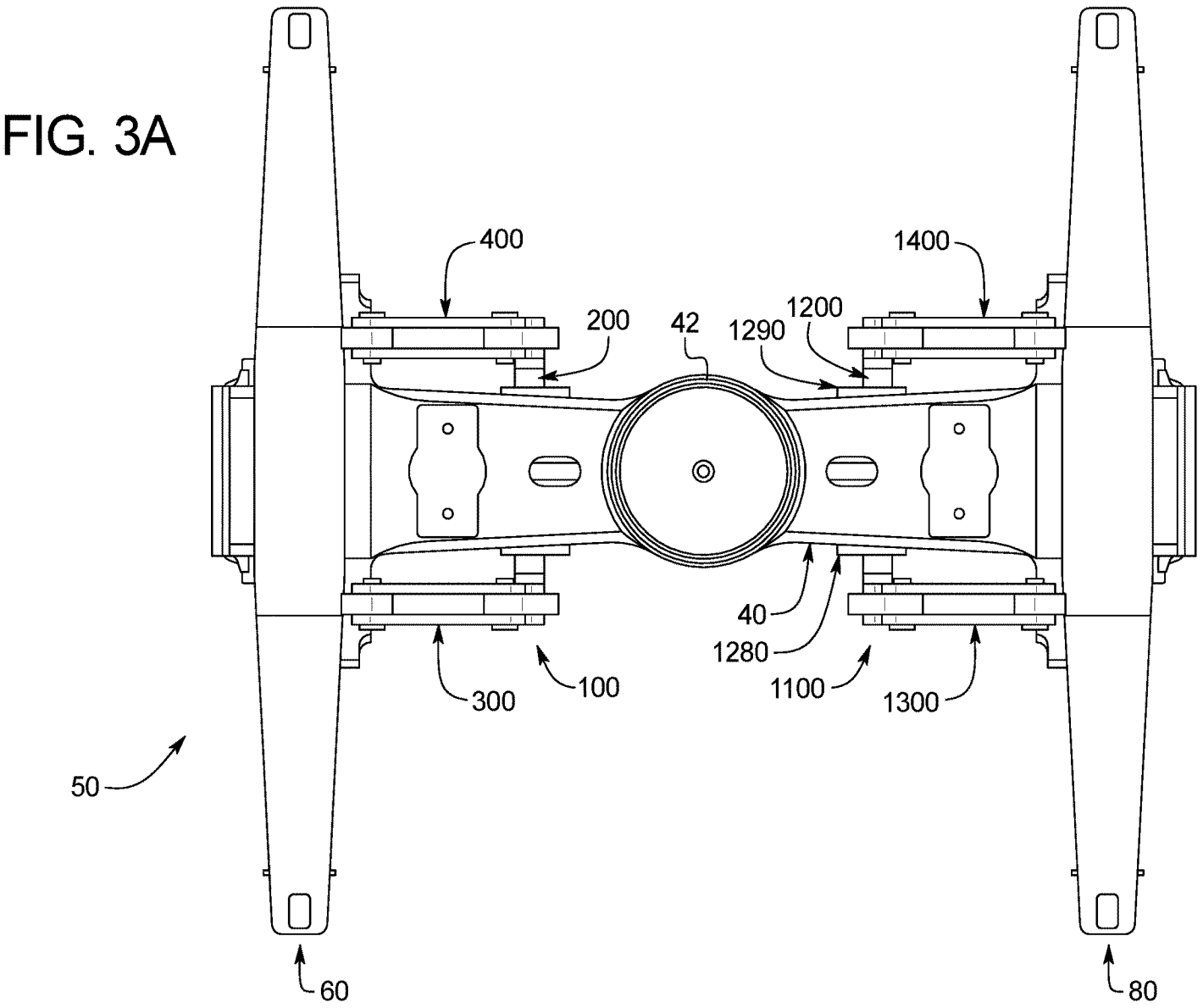
FIG. 3A is a top view of a bolster, two side frames, and two warp restraints of one example embodiment of the freight railroad car truck of the present disclosure, and illustrating the bolster in a square condition relative to the two side frames.
Figure 3B:
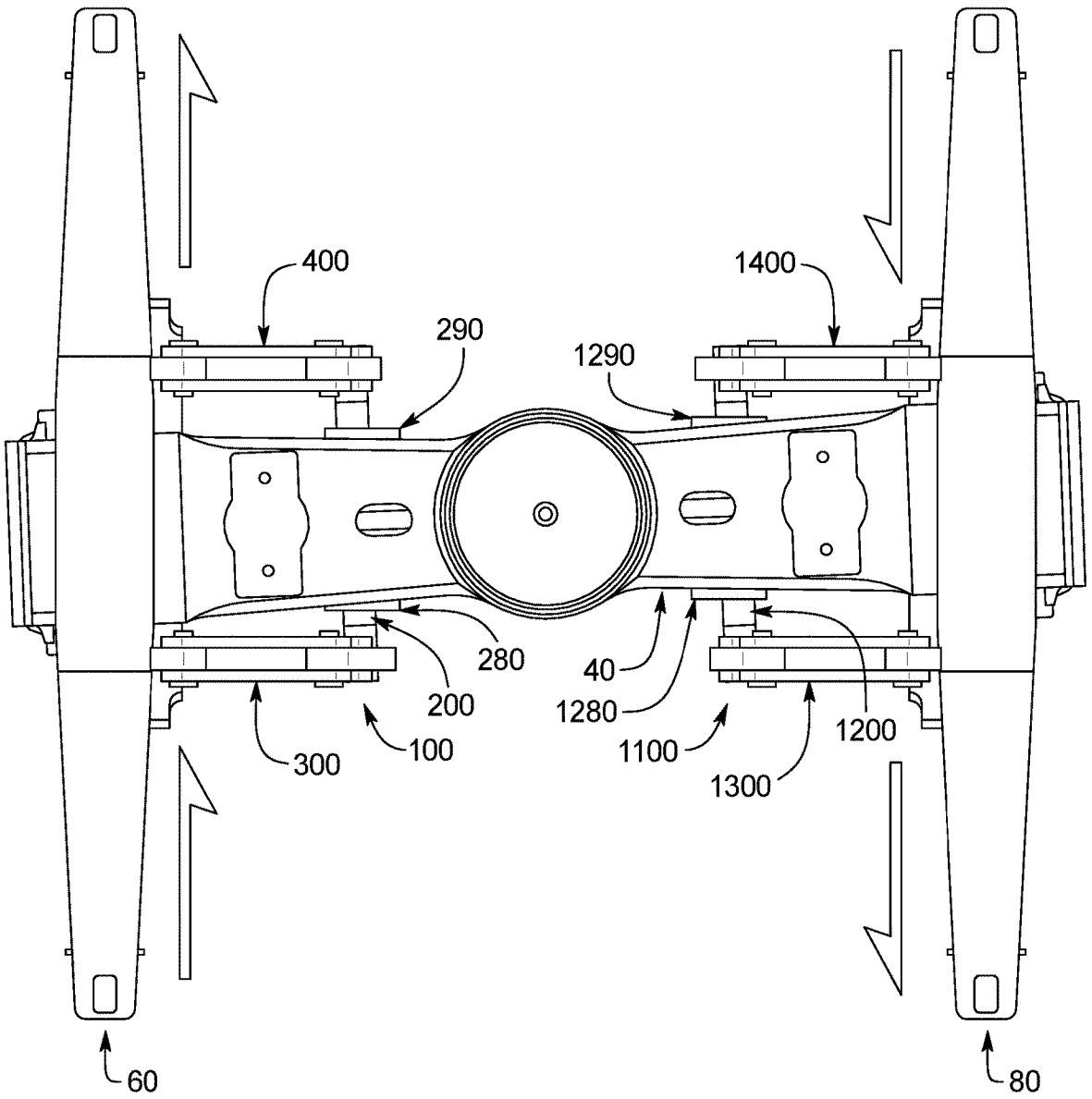
FIG. 3B is a top view of a bolster, two side frames, and two warp restraints of the example embodiment of the freight railroad car truck of FIG. 3A, wherein the truck is in a warped position, and wherein the warp restraints of FIG. 3A are applying biasing forces to urge the truck back to a square position.
Figure 4:
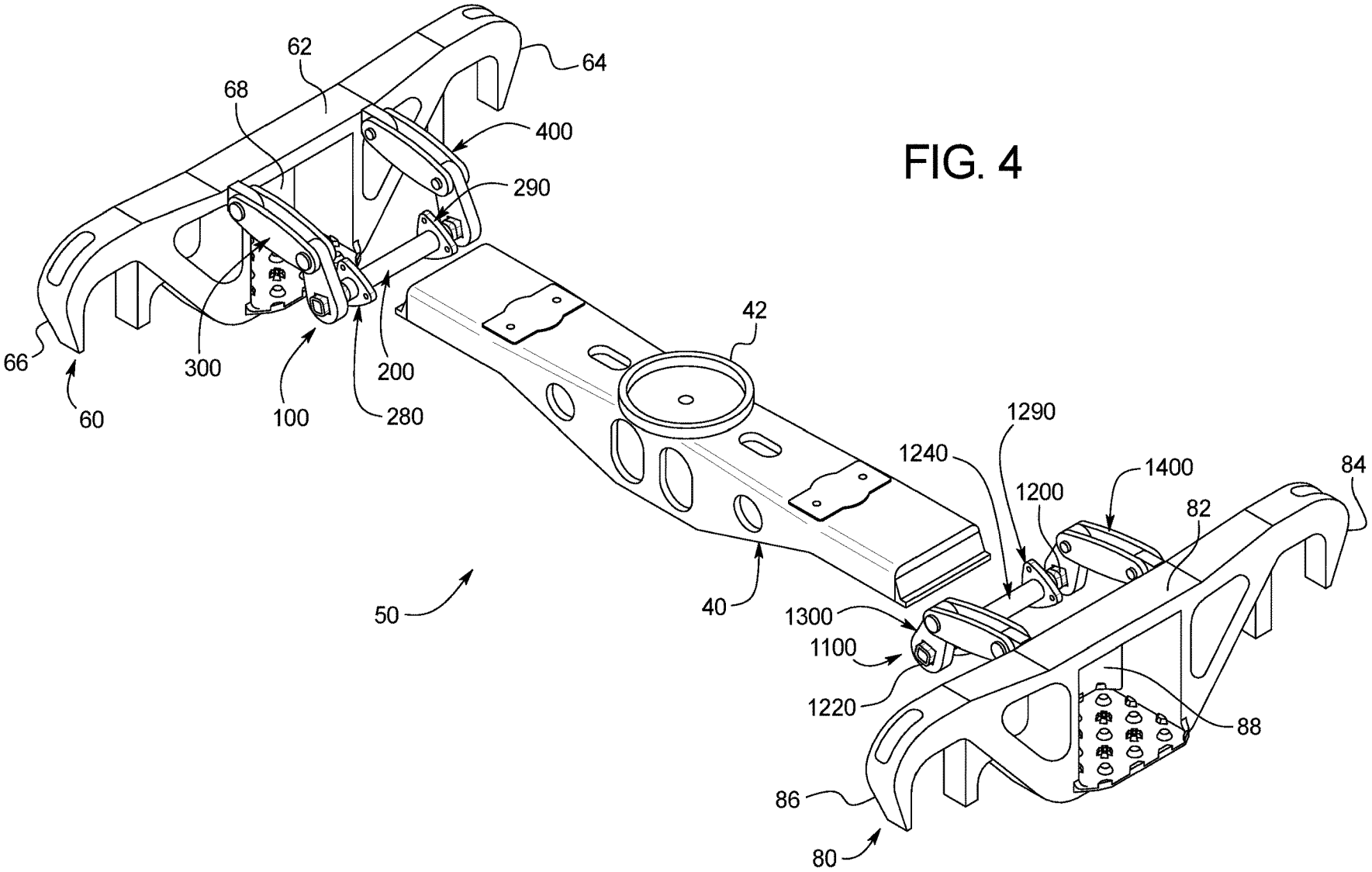
FIG. 4 is an exploded perspective view of the bolster, two side frames, and two warp restraints of the freight railroad car truck of FIG. 3A.
Figure 5:
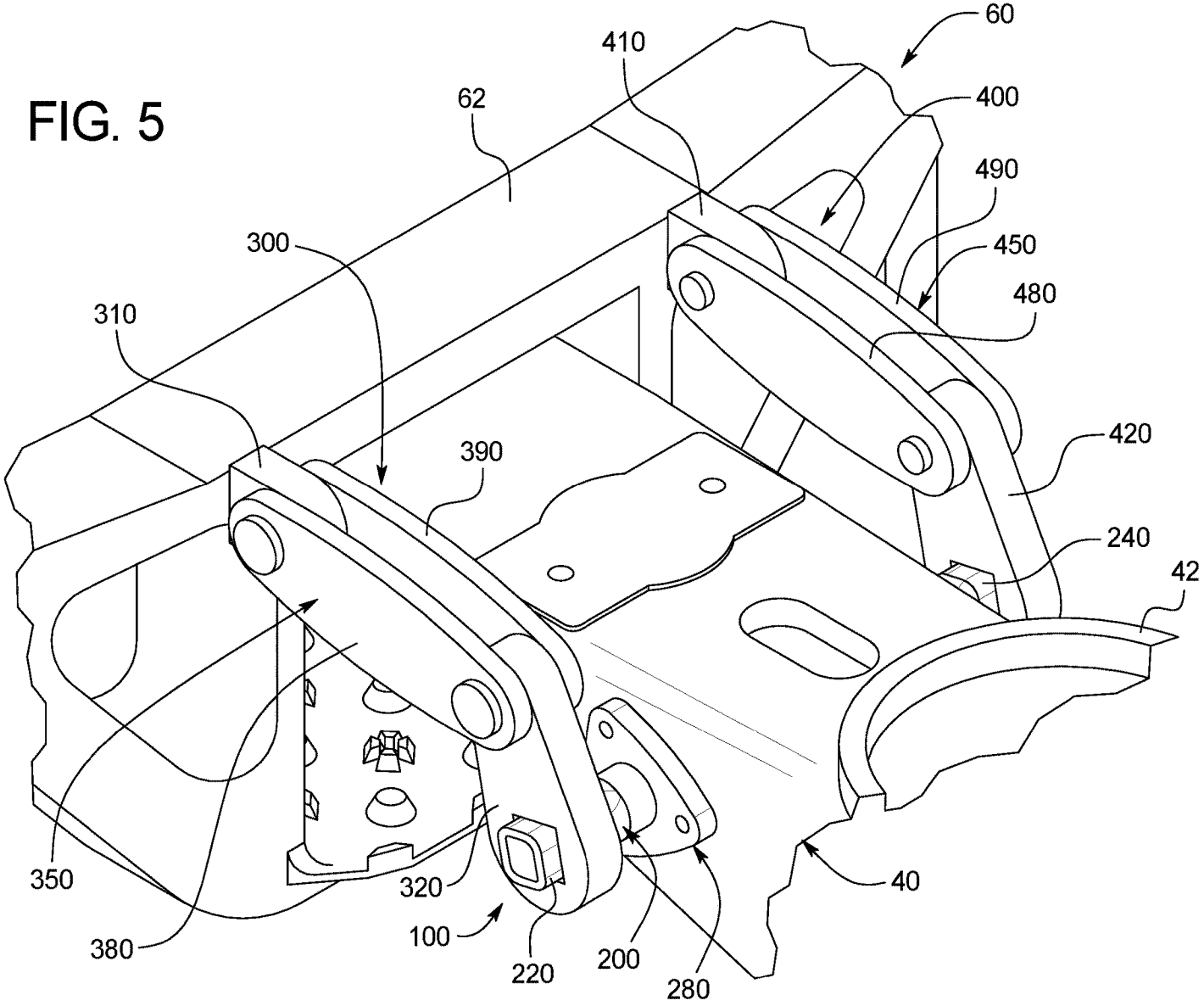
FIG. 5 is an enlarged fragmentary perspective view of the bolster, one of the side frames, and one of the warp restraints of the freight railroad car truck of FIG. 3A.
Figure 6:
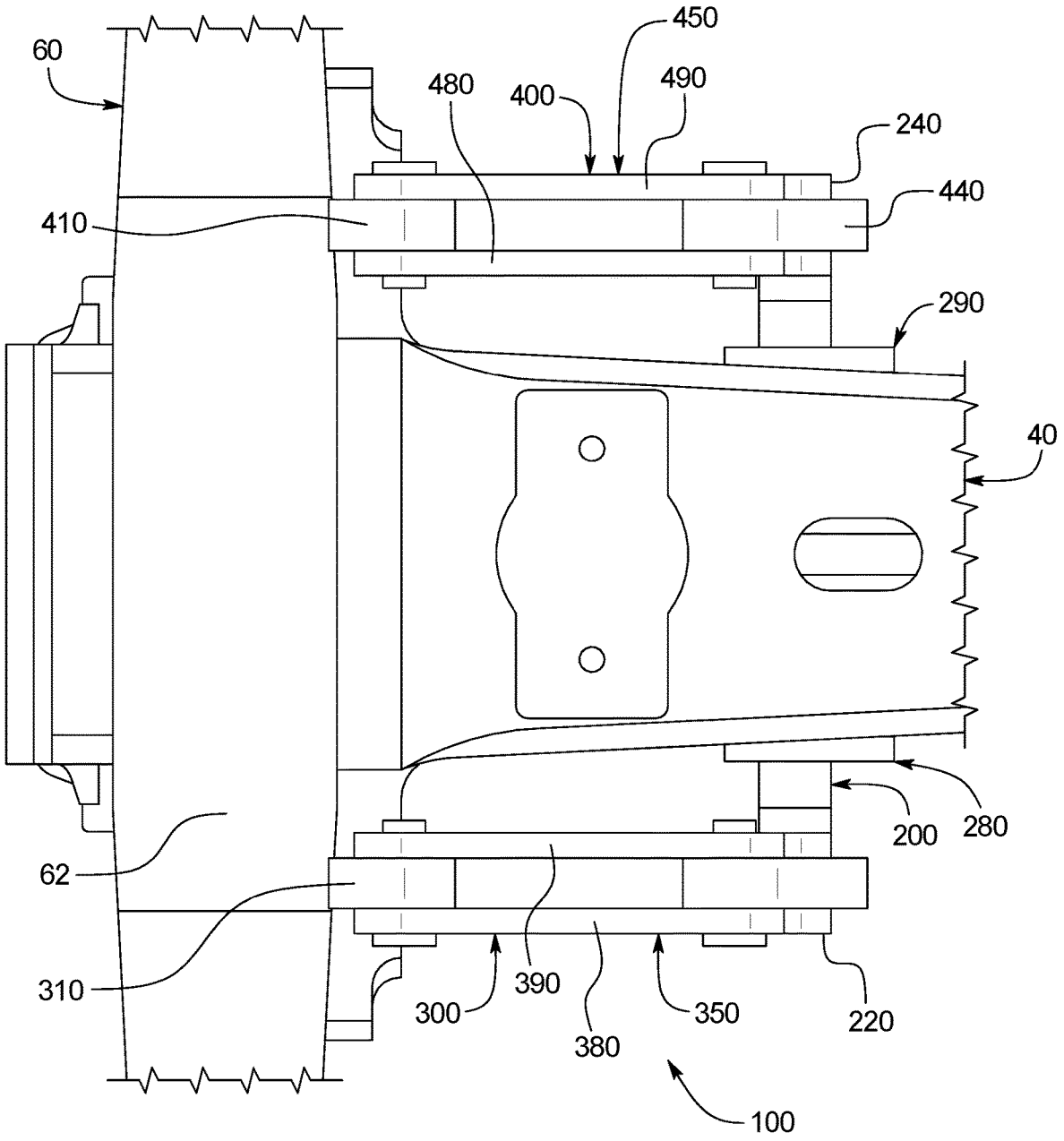
FIG. 6 is an enlarged fragmentary top view of one end portion of the bolster, a first one of the side frames, and one of the warp restraints of the freight railroad car truck of FIG. 3A.
Figure 7:
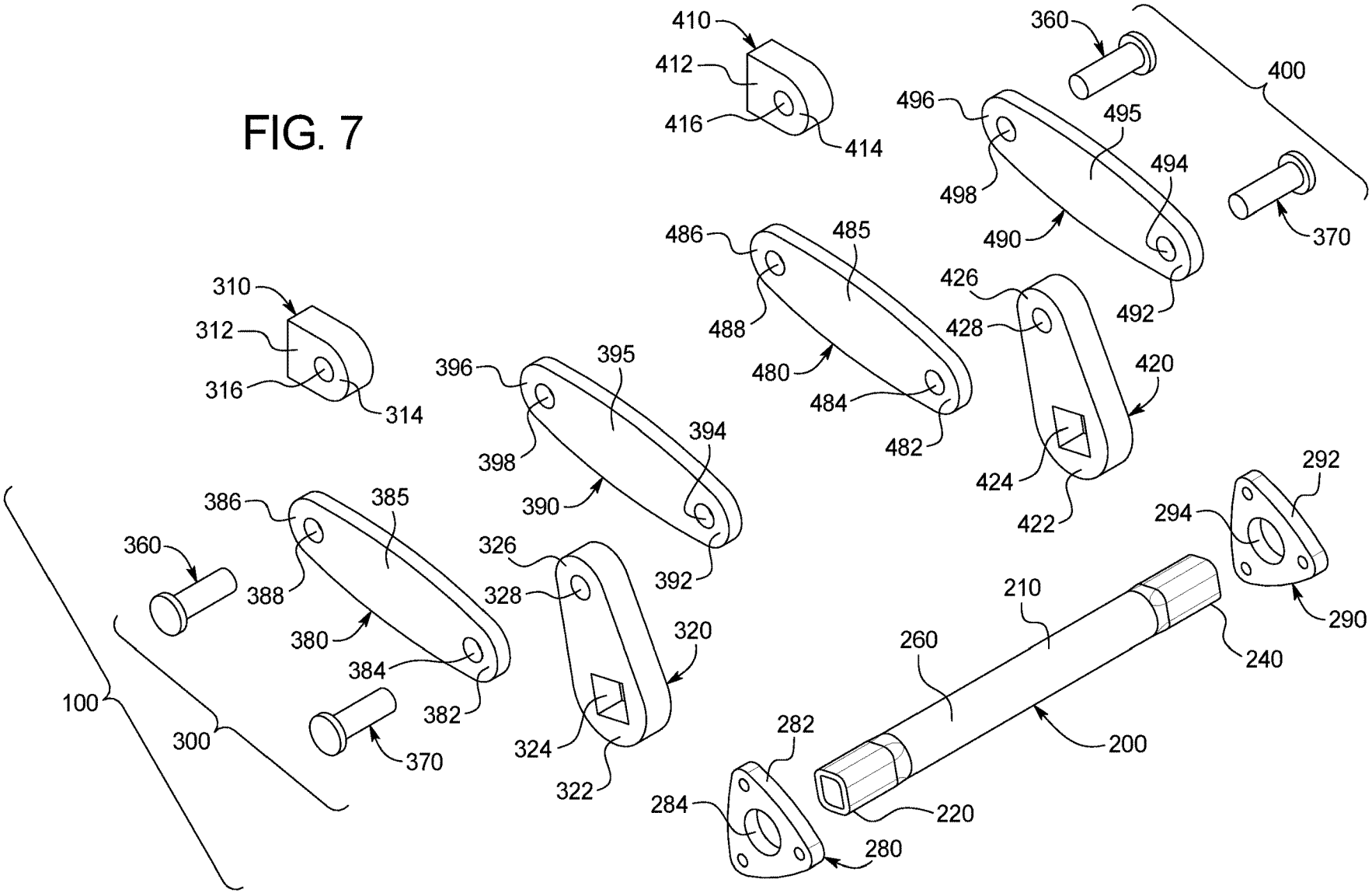
FIG. 7 is an enlarged exploded view of one of the warp restraints of the freight railroad car truck of FIG. 3A.

Thus, when the bolster 40 moves from a square or perpendicular position relative to the side frame 60, the warp restraint 2100 (independently and in combination with the warp restraint 1100) applies an opposing biasing forces to the bolster 40 and the side frame 60 to cause the bolster 40 and/or the side frame 60 to move in the respective opposing direction and return to their normal square, perpendicular, or substantially perpendicular positions relative to each other, and thus act or co-act to reduce, inhibit, and/or minimize warping. When warping occurs as generally shown in FIGS. 2 and 3A and the bolster 40 is not square with either of the side frames 60 or 80. The warp restraint apparatus 100 and 1100 of the present disclosure can: (1) independently apply counter biasing forces to the bolster 40; and (2) apply counter biasing forces to the bolster 40 in combination or co-act to cause the bolster 40 to return to its normal position and thus reduce, inhibit, and/or minimize warping. The warp restraint apparatus 100 and 1100 of the present disclosure thus act to bias the bolster 40 toward the square position relative to the side frames 60 and 80 such that the centerline or center plane of the bolster (that extends transversely relative to straight tracks) is perpendicular or substantially perpendicular to the centerlines or center planes of the respective side frames 60 and 80 (that extend longitudinally relative to straight tracks).

$2^{nd}$ Example Embodiment

Referring now to FIGS. 8A to 12, another example embodiment of a railroad car truck with the warp restraints of the present disclosure is shown and generally indicated by numeral 2050.

In this illustrated example embodiment of the present disclosure, the railroad car truck with warp restraints 2050 includes a bolster 2040, a bolster bowl 2042 on the bolster 2040, a first side frame 2060, and a second side frame 2080. Generally, the bolster 2040 is configured to extend transversely to the direction of the railroad tracks or rails, and the side frames 2060 and 2080 are configured to extend longitudinally in the same direction as the railroad tracks.

The side frame 2060 includes: (a) a longitudinally extending body 2062; and (b) two downwardly extending pedestal jaws (including a first pedestal jaw 2064 and a second pedestal jaw 2066) on opposite sides of the center opening 2068 in the body 2062 of the side frame 2060. The body 2062 includes a first side wall, a top wall, a second side wall, and a bottom wall that generally define the center opening 2068.

The side frame 2080 includes: (a) a longitudinally extending body 2082; and (b) two downwardly extending pedestal jaws (including a first pedestal jaw 2084 and a second pedestal jaw 2086) on opposite sides of the center opening 2088 in the body 2082 of the side frame 2080. The body 2082 includes a first side wall, a top wall, a second side wall, and a bottom wall that generally define the center opening 2088.

In this illustrated example embodiment of the present disclosure, as best shown in FIGS. 8A, 8B, 9, 10, 11, and 12, the railroad car truck with warp restraints 2050 includes: (1) a first warp restraint 2100; and (2) a second warp restraint 3100. The first warp restraint 2100 is connected to the side frame 2060 and a first end of the bolster 2040. The second warp restraint 3100 is connected to the side frame 2080 and an opposing second end of the bolster 2040.

In this illustrated example embodiment, the warp restraint 2100 generally includes: (a) a first torsion tube or member 2200 configured to be connected to and extend transversely through the first end of the bolster 2040 in a direction of travel of the railroad car or in the direction of the rails or tracks; (b) torsion tube bolster connectors 2280 and 2290; (c) a first linkage assembly 2300 configured to be connected to the side frame 2060 and connected to a first end 2220 of the torsion tube 2200; and (d) a second linkage assembly 2400 configured to be connected to the side frame 2060 and connected to the opposite end 2240 of the torsion tube 2200.

In this illustrated embodiment, the warp restraint 3100 likewise generally includes: (a) a second torsion tube or member 3200 configured to be connected to and extend transversely through the second end of the bolster 2040 in a direction of travel of the railroad car or in a direction of the rails or tracks; (b) torsion tube bolster connectors 3280 and 3290; (c) a first linkage assembly 3300 configured to be connected to the side frame 2080 and connected to a first end 3220 of the torsion tube 3200; and (d) a second linkage assembly 3400 configured to be connected to the side frame 2080 and connected to the opposite end 3240 of the torsion tube 3200.

It should be appreciated that each of the warp restraints 2100 and 3100 in this illustrated example embodiment and in various other embodiments of the present disclosure are identical or substantially identical (except for their respective positioning and arrangement with the side frames and the bolster). Since in this illustrated example embodiment, the first warp restraint 2100 and the second warp restraint 3100 are mirror images of each other, only first warp restraint 2100 will be discussed in detail herein for brevity. It should be appreciated that these warp restraints do not need to be mirror images of each other or identical or substantially identical in accordance with the present disclosure. It should also be appreciated that the warp restraint of the present disclosure can vary based on the respective positions and connections to or formations with the respective side frames and the bolster.

Turning now to warp restraint 2100, as best shown in FIGS. 9, 10, 11, and 12, the torsion tube 2200 includes an elongated body 2210 having a first or rear end 2220, an opposing second or front end 2240, and an intermediate section 2260 connecting the rear end 2220 and the front end 2220. In this illustrated example embodiment, the first or rear end 2220 is integrally connected to or formed with the intermediate section 2260, and the second or front end 2240 is also integrally connected to or formed with the intermediate section 2260. In this illustrated example embodiment, the torsion tube 2200 is made from a suitable steel or other suitable high-strength material. It should be appreciated that the torsion tube can be made from other suitable materials and in other suitable sizes and configurations.

The torsion tube 2200 extends transversely relative to the bolster such as extending through the first end of the bolster 2040 in a forward to rearward direction. In other words, the torsion tube 2200 generally extends relative to the bolster in the direction of travel of the truck 2050 and the entire railroad car. In this illustrated example embodiment, the torsion tube 2200 extends through aligned side-bearing access holes or openings in the front and rear walls of the first end of the bolster 2040. Such openings are partially shown in FIG. 9. It should be appreciated that these opening already exists in many known bolsters, which facilitates easy retrofitting of such bolsters with the warp restraints of the present disclosure. It should also be appreciated that the torque tubes of the present disclosure can be positioned through other suitable openings in the bolster in accordance with the present disclosure, or above or below the bolster and suitably connected thereto. In this illustrated example embodiment, the torsion tube 2200 is partially held in place by the walls of the bolster 2040 that define these respective openings.

In this illustrated example embodiment, the torsion tube 2200 is also partially held in place by torsion tube bolster connectors 2280 and 2290.

In this illustrated example embodiment, torsion tube bolster connector 2280 generally includes a somewhat triangular body 2282 configured to be mounted to the outer surface of the rear side wall of the bolster 2040 by suitable fasteners (not shown). The body 2282 of the torsion tube bolster connector 2280 includes an interior surface 2284 defining a cylindrical or substantially cylindrical opening through which the torsion tube 2200 extends. The body 2282 of the torsion tube bolster connector 2280 is configured to hold a part of the intermediate section 2260 of the torsion tube 2200 adjacent to the first or rear end 2220 of the torsion tube 2200. The body 2282 of the torsion tube bolster connector 2280 is configured to enable the intermediate section 2260 of the torsion tube 2200 to move rotate or twist relative to the body 2282 of the torsion tube bolster connector 2280. In this illustrated example embodiment, the torsion tube bolster connector 2280 is made from suitable bearing material such as but not limited to a UHMWPE, bronze, steel with low-friction inserts, or hardened steel; however, it should be appreciated that the torsion tube bolster connector 2280 can be made from other suitable materials and in other suitable shapes and configurations.

Likewise, in this illustrated example embodiment, torsion tube bolster connector 2290 generally includes a somewhat triangular body 2292 configured to be mounted to the outer surface of the front side wall of the bolster 2040 by suitable fasteners (not shown). The body 2292 of the torsion tube bolster connector 2290 includes an interior surface 2294 defining a cylindrical or substantially cylindrical opening through which the torsion tube 2200 extends. The body 2292 of the torsion tube bolster connector 2290 is configured to hold a part of the intermediate section 2260 of the torsion tube 2200 adjacent to the second or front end 2240 of the torsion tube 2200. The body 2292 of the torsion tube bolster connector 2290 is configured to enable the intermediate section 2260 of the torsion tube 2200 to move rotate or twist relative to the body 2292 of the torsion tube bolster connector 2290. In this illustrated example embodiment, the torsion tube bolster connector 2290 is made from suitable bearing material such as but not limited to a UHMWPE, bronze, steel with low-friction inserts, or hardened steel; however, it should be appreciated that the torsion tube bolster connector 2290 can be made from other suitable materials and in other suitable shapes and configurations.

The first or rear end 2220 of the torsion tube 2200 has a first engagement shape, structure, or mechanism to facilitate operable coupling or connection to the first linkage assembly 2300 such that: (a) rotational movement of the first or rear end 2220 of the torsion tube 2200 causes upward or downward or lateral movement of the lever arm 2320 of the first linkage assembly 2300; and (b) upward or downward or lateral movement of the lever arm 2320 of the first linkage assembly 2300 causes rotational movement of the first or rear end 2220 of the torsion tube 2200. In this illustrated example embodiment, the first or rear end 2220 has a generally rectangular shape (in cross-section) that functions as a whole or as part of the first engagement shape, structure, or mechanism.

Likewise, the second or front end 2240 of the torsion tube 2200 has a second engagement shape, structure, or mechanism to facilitate operable coupling or connection to the first linkage assembly 2400 such that: (a) rotational movement of the second or front end 2240 causes upward or downward movement of the lever arm 2420 of the second linkage assembly 2400; and (b) upward or downward or lateral movement of the lever arm 2420 of the second linkage assembly 2400 causes rotational movement of the second or front end 2240. In this illustrated example embodiment, the second or front end 2240 has a generally rectangular shape (in cross-section) that functions as a whole or as part of the second engagement shape, structure or mechanism.

The first or rear linkage 2300 generally includes: (a) a side frame bracket 2310 fixedly connected to the side frame 2060; (b) the lever arm 2320 operably coupled or connected to the first or rear end 2220 of the torsion tube 2200 as described above; and (c) a connecting arm assembly 2350 operably coupled or connected to the side frame bracket 2310 and operably coupled or connected to the lever arm 2320. In this illustrated example embodiment, the side frame bracket 2310 is made from steel, the lever arm 2320 is made from steel, and the connecting arm assembly 2350 is made from steel. It should be appreciated that one or more of these components can be made from other suitable materials.

The side frame bracket 2310 is configured to be fixedly attached to the side frame 2060 such as by welding. The side frame bracket 2310 includes a side frame mounting base or portion 2312 and an attachment arm 2314 extending from the mounting base 2312. The attachment arm 2314 includes an upwardly extending connection hand 2315.

The lever arm 2320 includes a body having a lower end 2322 that includes an inner surface that defines a torsion bar receiving opening 2324. In this example embodiment, the inner surface and the torsion bar receiving opening 2324 correspond to the first engagement shape, structure, or mechanism of the first or rear end 2220 of the torsion tube 2200 to facilitate operable coupling or connection to the torsion bar 2200 such that: (a) rotational movement of the first or rear end 2220 of the torsion tube 2200 causes upward or downward or lateral movement of the lever arm 2320; and (b) upward or downward or lateral movement of the lever arm 2320 causes rotational movement of the first or rear end 2220 of the torsion tube 2200. In this illustrated example embodiment, inner surface that defines the torsion bar receiving opening 2324 has a generally rectangular shape (in cross-section). The body of the lever arm 2320 also includes an upper end 2326 that includes an upwardly extending connection hand 2328 for facilitating operable connection to the connecting arm assembly 2350.

The connecting arm assembly 2350 includes connecting arm or member 2380. The connecting arm or member 2380 includes an elongated body having: (a) a first end that functions as a lever arm coupler 2382; (b) a second opposing end that functions as a side frame bracket coupler 2386; and (c) an intermediate section that functions as a connecting member 2385 connecting the first end or lever arm coupler 2382 to the second end or side frame bracket coupler 2386.

The first end that functions as a lever arm coupler 2382 includes opposing spaced apart bearings 2384A and 2384B that define a lever arm connection hand receiving opening 2385 there between. The lever arm connection hand receiving opening 2385 is sized and configured to receive the connection hand 2328 of the lever arm 2320 such that the connection hand 2328 and the lever arm 2320 are operably connected or coupled. The bearings 2384A and 2384B are configured to engage opposite sides of the connection hand 2328. In this illustrated embodiment, the bearings 2384A and 2384B are each at least partially rounded to facilitate engagement with the connection hand 2328.

The second end that functions as a side frame bracket coupler 2386 includes opposing spaced apart bearings 2387A and 2387B that define a side frame bracket arm connection hand receiving opening 2388 there between. The side frame bracket connection hand receiving opening 2388 is sized and configured to receive the connection hand 2315 of the side frame bracket 2310 such that the connection hand 2315 and the side frame bracket coupler 2386 are operably connected or coupled. The bearings 2387A and 2387B are configured to engage opposite sides of the connection hand 2315. In this illustrated embodiment, the bearings 2387A and 2387B are each at least partially rounded to facilitate engagement with the connection hand 2315.

Likewise, the second or front linkage 2400 generally includes: (a) a side frame bracket 2410 fixedly connected to the side frame 2060; (b) the lever arm 420 operably coupled or connected to the second or front end 2240 of the torsion tube 2200, as described above; and (c) a connecting arm assembly 2450 operably coupled or connected to the side frame bracket 2410 and operably coupled or connected to the lever arm 2420. In this illustrated example embodiment, the side frame bracket 2410 is made from steel, the lever arm 2420 is made from steel, and the connecting arm assembly 2450 is made from steel. It should be appreciated that one or more of these components can be made from other suitable materials.

The side frame bracket 2410 is configured to be fixedly attached to the side frame 2060 such as by welding. The side frame bracket 2410 includes a side frame mounting base or portion 2412 and an attachment arm 2414 extending from the mounting base 2412. The attachment arm 2414 includes an upwardly extending connection hand 2415.

The lever arm 2420 includes a body having a lower end 2422 that includes an inner surface that defines a torsion bar receiving opening 2424. In this example embodiment, the inner surface and the torsion bar receiving opening 2424 correspond to the second engagement shape, structure, or mechanism of the second or front end 2240 of the torsion tube 2200 to facilitate operable coupling or connection to the torsion bar 2200 such that: (a) rotational movement of the second or front end 2240 of the torsion tube 2200 causes upward or downward or lateral movement of the lever arm 2420; and (b) upward or downward or lateral movement of the lever arm 2420 causes rotational movement of the second or front end 2240 of the torsion tube 2200. In this illustrated example embodiment, inner surface that defines the torsion bar receiving opening 2424 has a generally rectangular shape (in cross-section). The body of the lever arm 2420 also includes an upper end 2426 that includes an upwardly extending connection hand 2428 for facilitating operable connection to the connecting arm assembly 2450.

The connecting arm assembly 2450 includes a connecting arm or member 2480. The connecting arm or member 2480 includes an elongated body having: (a) a first end that functions as a lever arm coupler 2482; (b) a second opposing end that functions as a side frame bracket coupler 2486; and (c) an intermediate section that functions as a connecting member 2485 connecting the first end or lever arm coupler 2482 to the second end or side frame bracket coupler 2486.

The first end that functions as a lever arm coupler 2482 includes opposing spaced apart bearings 2484A and 2484B that define a lever arm connection hand receiving opening 2485 there between. The lever arm connection hand receiving opening 2485 is sized and configured to receive the connection hand 2428 of the lever arm 2420 such that the connection hand 2428 and the lever arm 2420 are operably connected or coupled. The bearings 2484A and 2484B are configured to engage opposite sides of the connection hand 2428. In this illustrated embodiment, the bearings 2484A and 2484B are each at least partially rounded to facilitate engagement with the connection hand 2428.

The second end that functions as a side frame bracket coupler 2486 includes opposing spaced apart bearings 2487A and 2487B that define a side frame bracket arm connection hand receiving opening 2488 there between. The side frame bracket connection hand receiving opening 2488 is sized and configured to receive the connection hand 2415 of the side frame bracket 2410 such that the connection hand 2415 and the side frame bracket coupler 2486 are operably connected or coupled. The bearings 2487A and 2487B are configured to engage opposite sides of the connection hand 2415. In this illustrated embodiment, the bearings 2487A and 2487B are each at least partially rounded to facilitate engagement with the connection hand 2415.

It should be appreciated from the above, that when the bolster 2040 moves out of the square position relative to the side frame 2060, the movement of the side frames 2060 relative to the bolster 2040 will generally cause the one of or both of the first linkage assembly 2300 and the second linkage assembly 2400 to cause one or more of the ends of the torque tube 2200 to twist. When or after being twisted, the torque tube 2200 will want to return to its normal shape or resting position, and thus the torque tube 2200 will cause one or more of those cause one or more of those twisted ends of the torque tube 2200 to twist back toward their original or resting shape. This force will in turn cause opposite movements of the lever arms 2320 and 2420, which will in turn causes opposite movements of the connecting arms assemblies 2350 and 2450, which will in turn exert opposite forces on the side frames brackets and side frames. Thus, when warping starts to occur, each lever arm will apply twisting forces to the torsion tube 2200, the material of the tube will respond elastically and thus resist or counter act the warping forces.

It should thus be appreciated that these components, their positions, and the relative connections and couplings (including the sets of pivotal connections) of the warp restraint 2100: (a) provide and limit the respective movements of each component relative to each other component; (b) co-act to provide a linkage from the side frame 2060 to the first or rear end 2220 of the torque tube 2200 and to the second or front end 2240 of the torque tube 2200; and (c) result in applying opposing forces to the side frame 2060 and bolster 2040 to reduce, inhibit, and/or minimize warping.

Figure 8A:
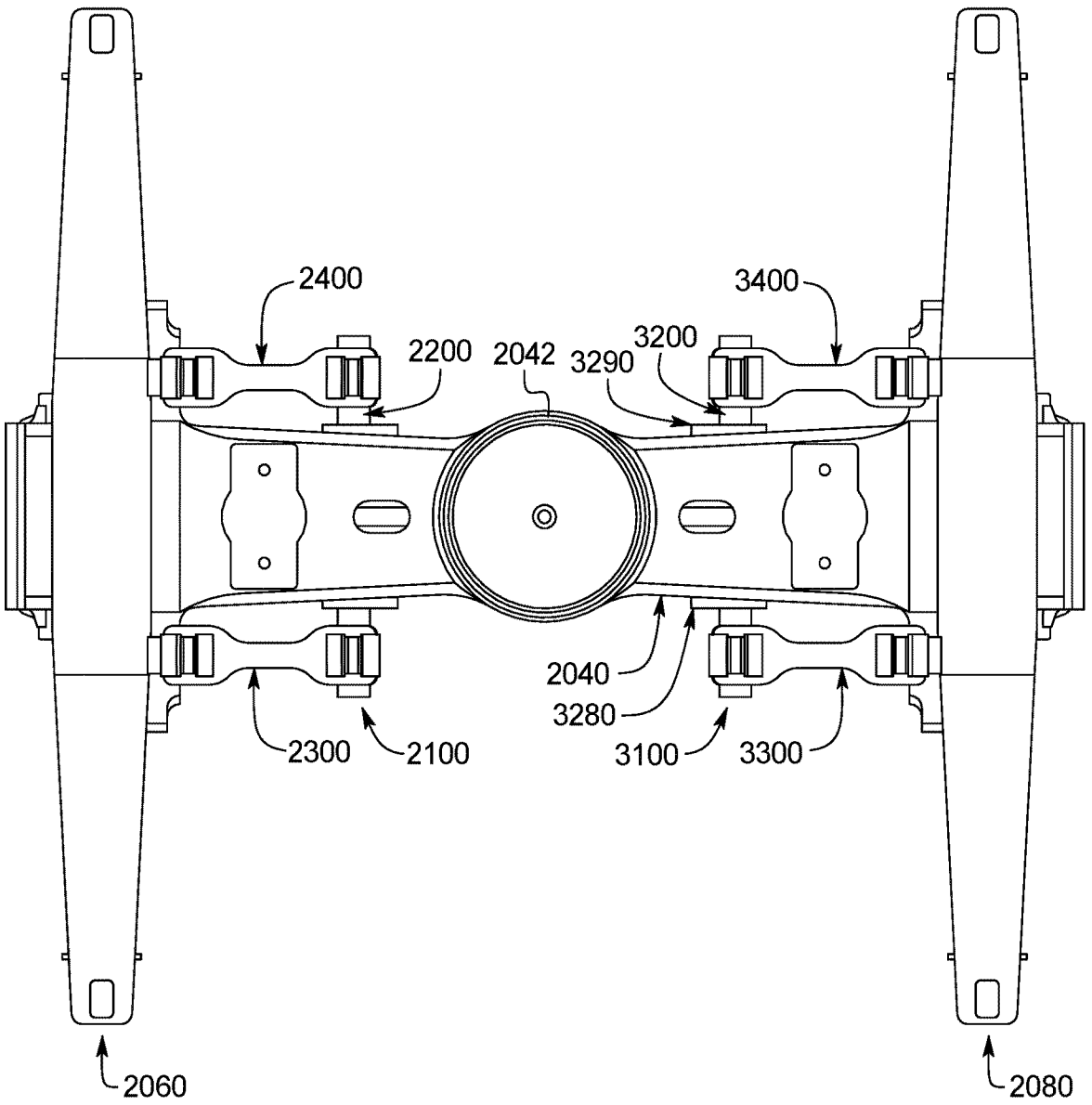
FIG. 8A is a top view of a bolster, two side frames, and two warp restraints of another example embodiment of the freight railroad car truck of the present disclosure, and illustrating the bolster in a square condition relative to the two side frames.
Figure 8B:
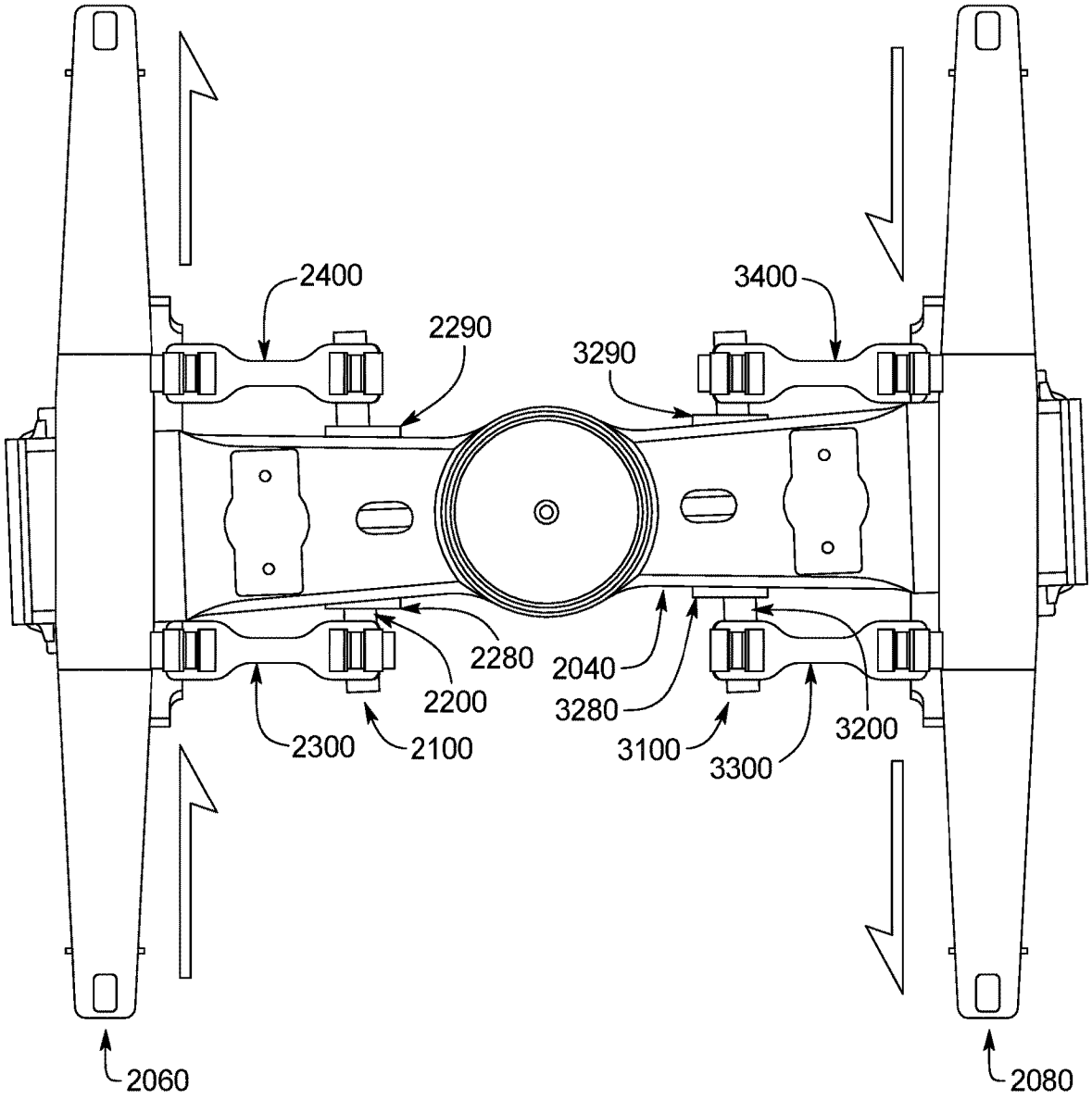
FIG. 8B is a top view of a bolster, two side frames, and two warp restraints of the example embodiment of the freight railroad car truck of FIG. 8A, wherein the truck is in a warped position, and wherein the warp restraints of FIG. 8A are applying biasing forces to urge the truck back to a square position.
Figure 9:
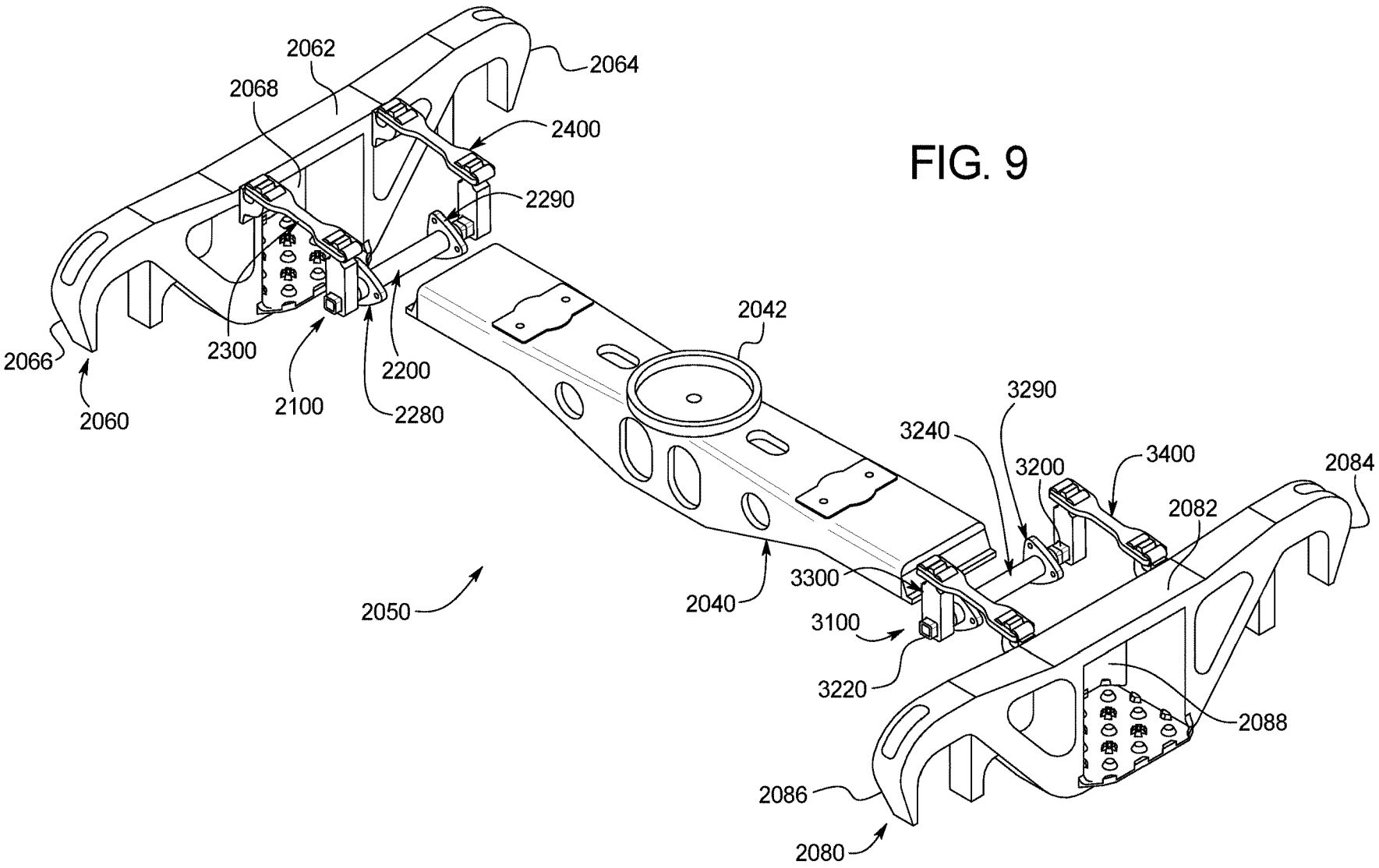
FIG. 9 is an exploded perspective view of the bolster, two side frames, and two warp restraints of the freight railroad car truck of FIG. 8A.
Figure 10:
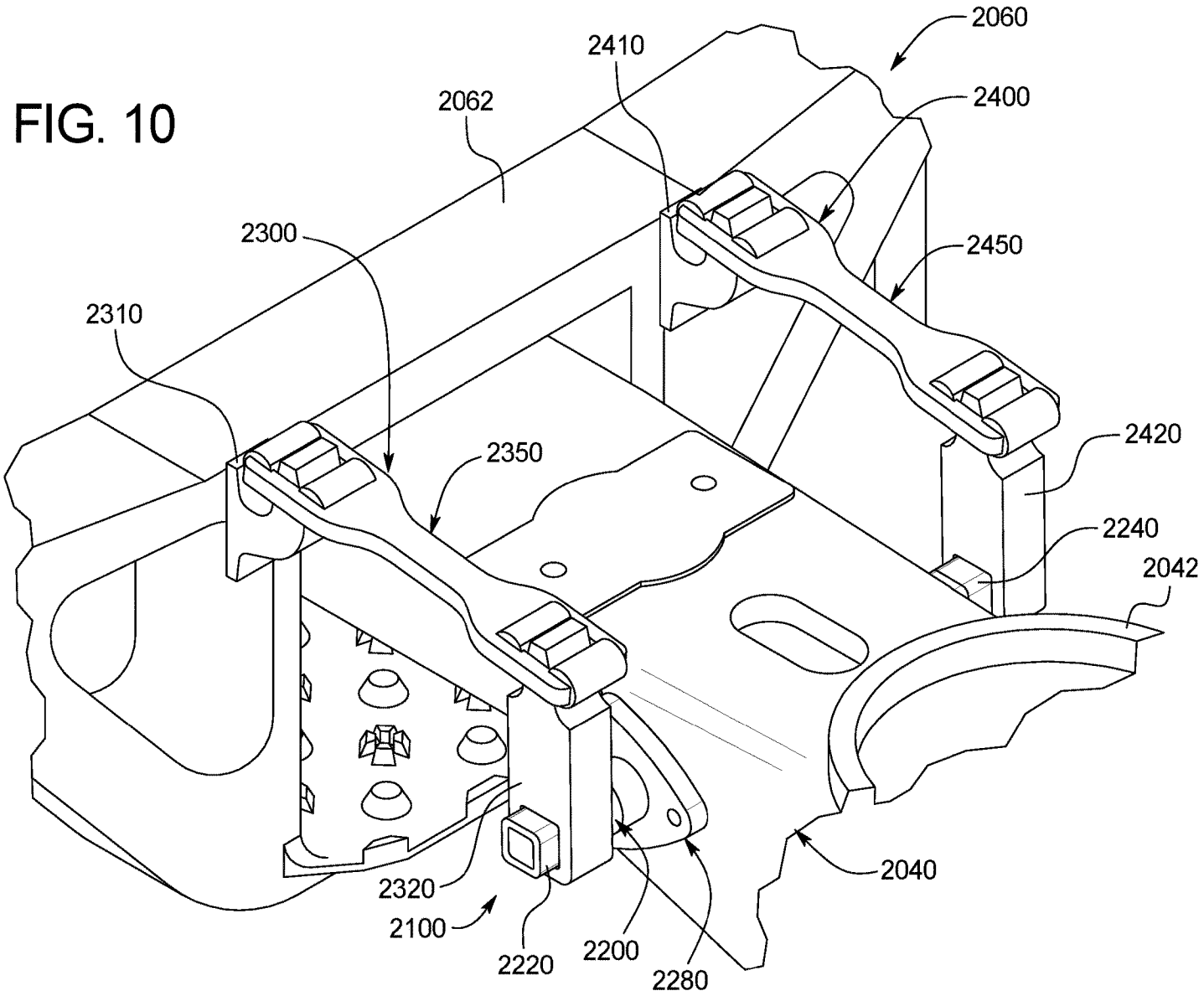
FIG. 10 is an enlarged fragmentary perspective view of the bolster, one of the side frames, and one of the warp restraints of the freight railroad car truck of FIG. 8A.
Figure 11:
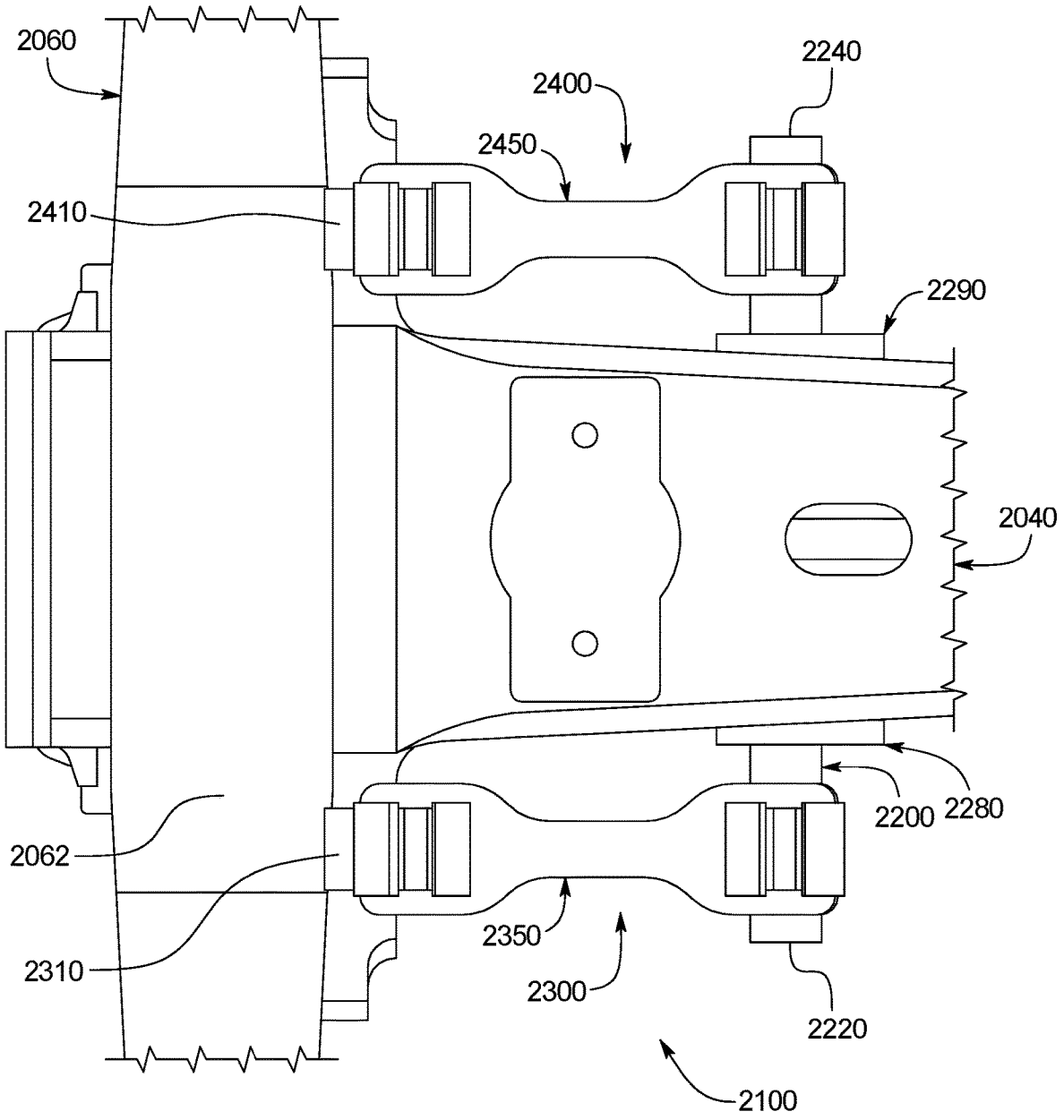
FIG. 11 is an enlarged fragmentary top view of one end portion of the bolster, a first one of the side frames, and one of the warp restraints of the freight railroad car truck of FIG. 8A.
Figure 12:
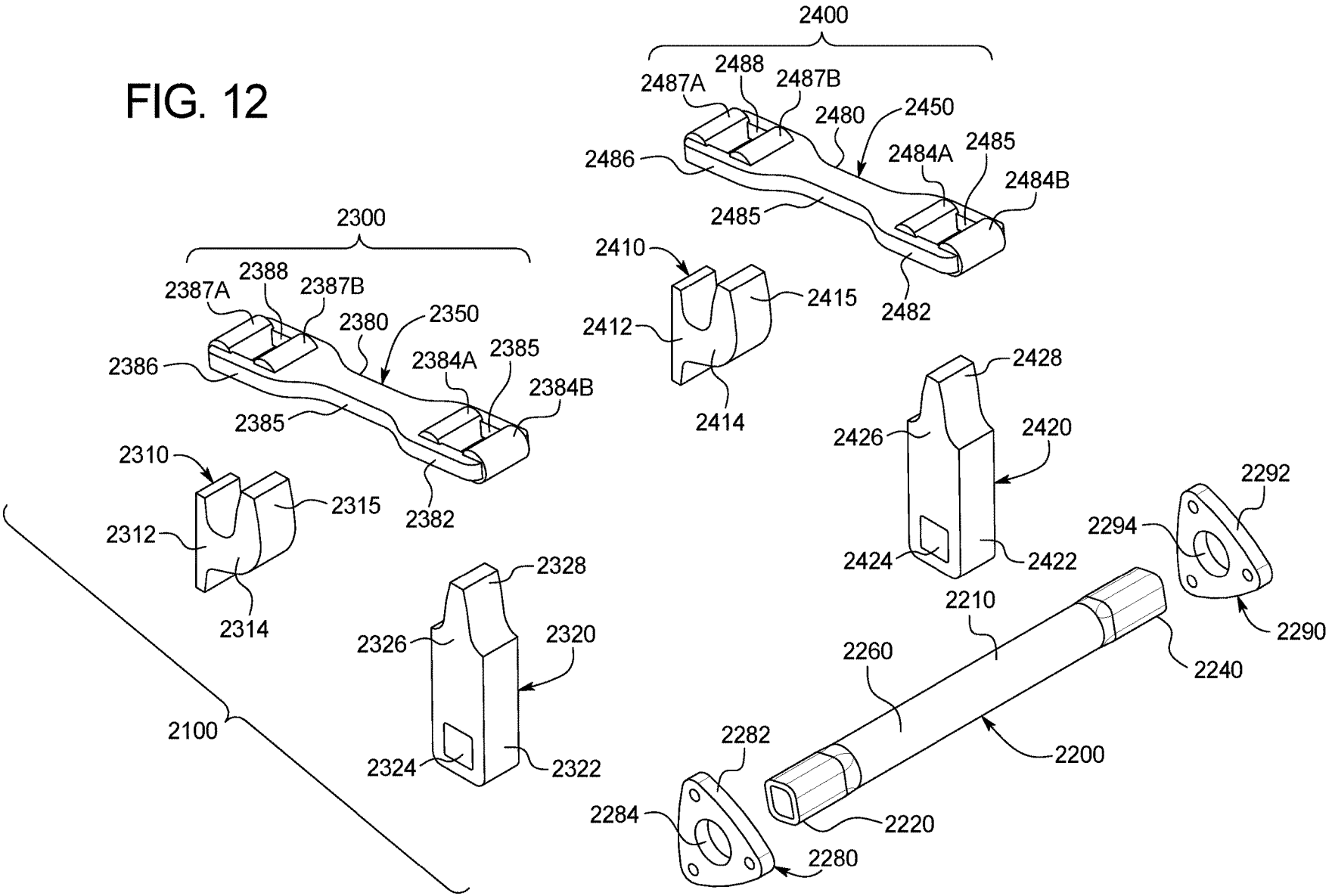
FIG. 12 is an enlarged exploded view of one of the warp restraints of the freight railroad car truck of FIG. 8A.

Thus, when the bolster 2040 moves from a square or perpendicular position relative to the side frame 2060, the warp restraint 2100 (independently and in combination with the warp restraint 3100) applies an opposing biasing forces to the bolster 2040 and the side frame 2060 to cause the bolster 2040 and/or the side frame 2060 to move in the respective opposing direction and return to their normal square, perpendicular, or substantially perpendicular positions relative to each other, and thus act or co-act to reduce, inhibit, and/or minimize warping. When warping occurs as generally shown in FIG. 8B and the bolster 2040 is not square with either of the side frames 2060 or 2080. The warp restraint apparatus 2100 and 3100 of the present disclosure can: (1) independently apply counter biasing forces to the bolster 2040; and (2) apply counter biasing forces to the bolster 2040 in combination or co-act to cause the bolster 2040 to return to its normal position and thus reduce, inhibit, and/or minimize warping. The warp restraint apparatus 2100 and 3100 of the present disclosure thus act to bias the bolster 2040 toward the square positions relative to the side frames 2060 and 2080 such that the centerline or center plane of the bolster (that extends transversely relative to straight tracks) is perpendicular or substantially perpendicular to the centerlines or center planes of the respective side frames 2060 and 2080 (that extend longitudinally relative to straight tracks).

Additional Embodiments

It should be appreciated that in various embodiments and in various circumstances, the warp restraints of the present disclosure may also act to provide other biasing forces to the bolster relative to the side frames and/or may co-act with one or more other components of the railroad car truck to provide other biasing forces to the bolster relative to the side frames. These other biasing effects of the warp restraints of the present disclosure can be considered as secondary potential biasing effects.

More specifically, known prior art railroad cars trucks typically have bolsters that have free lateral or transverse movement relative to the side frames of around +/−½ inches, where the end of that lateral or transverse travel is limited by or arrested by stopping members that are often called "Gibs". Gibs are the physical blocks that prevent movement beyond this travel allowance. In certain embodiments of the present disclosure, the warp restraints act with certain of the Gibs.

In another example of possible secondary biasing forces provided by the warp restraints of the present disclosure, in certain embodiments, the warp restraints may co-act with the springs or spring groups of the truck to provide biasing forces to the bolster relative to the side frames. In these embodiments, the lateral or transverse movement of the bolster relative to the side frames is partially controlled by the equilibrium preference of the spring group on which the bolster rides. In other words, in these embodiments, the spring groups provide lateral elasticity, as well as vertical elasticity, to the interaction between the bolster and the springs. More specifically, in certain of these embodiments of the warp restraints lateral biasing forces (beyond that provided by the spring group) are expected to be produced. However, it should be appreciated that one advantage of various embodiment of the present disclosure is to not alter or supplement (or appreciably alter or supplement) the lateral or vertical elasticity of the spring-group-bolster-side-frame connection. Thus, various embodiments of the present disclosure are intended to and capable of not affecting those parameters at all (or appreciably).

Thus, in only certain circumstances and only certain embodiments of the present disclosure, if the bolster moves laterally or transversely outwardly relative to the side frame, the warp restraints may be expected to exert certain biasing forces to the bolster and the side frame to cause the bolster to move in an opposite direction laterally or transversely inward relative to the side frame and return to its normal position.

Likewise, in only certain circumstances and only certain embodiments of the present disclosure, if the bolster moves laterally or transversely inwardly relative to the side frame, the warp restraints may be expected to exert certain biasing forces to the bolster and the side frame to cause the bolster to move in an opposite direction laterally or transversely outward relative to the side frame and return to its normal position. However, it should be appreciated that various embodiments of the present disclosure are intended to and capable of not providing these biasing forces at all (or appreciably).

The warp restraints of certain embodiments of the present disclosure can also inhibit or reduce longitudinal movement of the bolsters relative to the side frames depending upon the shape and angles of the bearings. For example, in certain embodiments, if the bolster begins to move forward longitudinally relative to the side frame, the warp restraints can exert biasing forces to the bolster and the side frame to cause the bolster to move in an opposite direction rearwardly longitudinally relative to the side frame and return to its normal position. Likewise, in certain embodiments, if the bolster begins to move rearward longitudinally relative to the side frame, the warp restraints can exert biasing forces to the bolster and the side frame to cause the bolster to move in an opposite direction forwardly longitudinally relative to the side frame and return to its normal position. However, it should be appreciated that various embodiments of the present disclosure are intended to and capable of not providing these biasing forces at all (or appreciably).

It should also be appreciated that most movements of the bolster relative to the side frames will likely be in a direction that may be a combination of different directions, and that the warp restraints can act in combination or co-act with one or more other components of the truck to cause the bolster and side frames to move in opposing directions to return to their normal positions; thus preventing, reducing, and/or inhibiting warping while also possibly applying other additional secondary forces as explained above. However, it should be appreciated that various embodiments of the present disclosure are intended to and capable of not providing these biasing forces at all (or appreciably).

It should further be appreciated that the warp restraints of the present disclosure require adding relatively little additional material or weight to the truck to provide additional stiffness.

It should be appreciated that in various embodiments, one or more of the surfaces of the bearings do not need any lubrication.

It will be understood that modifications and variations may be effected without departing from the scope of the novel concepts of the present invention, and it is understood that this application is to be limited only by the scope of the claims.

The invention is claimed as follows:

1. A railroad car truck comprising:

a first side frame;

a second side frame;

a bolster extending between the first side frame and the second side frame; and a first warp restraint, including:

a first linkage assembly with a first end pivotally connected to an inner surface of the first side frame, the first linkage assembly extending along the bolster and toward the second side frame, and a second end of the first linkage assembly operably connected to the first end of a first torsion tube, and a second linkage assembly with a first end pivotally connected to the inner surface of the first side frame, the second linkage assembly extending along the bolster and toward the second side frame, and a second end of the second linkage assembly operably connect to the second end of the first torsion tube, and the first torsion tube positioned at a connection point with the bolster between the first side rail and second side rail, the first torsion tube extending transversely relative to the bolster from the second end of the first linkage assembly on a first side of the bolster, through the connection point, to the second end of the second linkage assembly on a second side of the bolster opposite the first side.

2. The railroad car truck of claim 1, wherein the first torsion tube is made from a high strength material and passes through an opening in each side of the bolster.

3. The railroad car truck of claim 1, where the first torsion tube extends above or below the bolster, and the first linkage assembly and the second linkage assembly extend parallel to a central axis of the bolster.

4. The railroad car truck of claim 1, wherein the first end of the first torsion tube includes a first engagement mechanism to facilitate operable connection to the first linkage assembly, and wherein the second end of the first torsion tube includes a second engagement mechanism to facilitate operable connection to the second linkage assembly.

5. The railroad car truck of claim 1, wherein the first torsion tube passes through openings in bolster, and first and second torsion tube bolster connectors are positioned at the openings in the bolster.

6. The railroad car truck of claim 1, wherein the first linkage assembly includes a side frame bracket fixedly connected to the first side frame, a lever arm operably connected to the first end of the torsion tube, and a connecting arm assembly movably connected to the side frame bracket and movably connected to the lever arm.

7. The railroad car truck of claim 6, wherein the second linkage assembly includes a side frame bracket fixedly connected to the first side frame, a lever arm operably connected to the second end of the torsion tube, and a connecting arm assembly movably connected to the side frame bracket and movably connected to the lever arm.

8. The railroad car truck of claim 6, wherein the connecting arm assembly includes: (a) a first connecting arm; (b) a second connecting arm; (c) a first pivot pin; and (d) a second pivot pin.

9. The railroad car truck of claim 8, wherein the first connecting arm includes an elongated body having: (a) a lever arm coupler; (b) a side frame bracket coupler; and (c) a connecting member connecting the lever arm coupler to the side frame bracket coupler.

10. The railroad car truck of claim 9, wherein the second connecting arm includes an elongated body having: (a) a lever arm coupler; (b) a side frame bracket coupler; and (c) a connecting member connecting the lever arm coupler to the side frame bracket coupler.

11. The railroad car truck of claim 10, wherein the first pivot pin of the connecting arm assembly: (a) pivotally connects the side frame bracket coupler of the first connecting arm to the side frame bracket; and (b) pivotally connects the side frame bracket coupler of the second connecting arm to the side frame bracket.

12. The railroad car truck of claim 11, wherein the second pivot pin of the connecting arm assembly: (a) pivotally connects the lever arm coupler of the first connecting arm to the lever arm; and (b) pivotally connects the lever arm coupler of the second connecting arm to the lever arm.

13. The railroad car truck of claim 1, which includes a second warp restraint including:

a second torsion tube extending transversely through openings in the bolster, the second torsion tube having a first end and a second end opposite the first end;

a first linkage assembly comprising a first end pivotally connected to the second side frame, and the first linkage assembly extending alongside the bolster to operably connect a second end of the first linkage assembly to the first end of the second torsion tube; and a second linkage assembly comprising a first end pivotally connected to the second side frame and the second linkage assembly extending alongside the bolster to operably connect a second end of the second linkage assembly to the second end of the second torsion tube.

14. A railroad car truck comprising:

a first side frame;

a second side frame;

a bolster extending between the first side frame and the second side frame; and a first warp restraint, including:

a first linkage assembly comprising a first end mounted on an inner surface of the first side frame and a second end connected to a first end of a first torsion tube, and the first linkage assembly extending along a first side of the bolster and toward a midpoint of the bolster, and a second linkage assembly comprising a first end mounted on the inner surface of the first side frame and a second end connected to a second end of the first torsion tube, and the second linkage assembly extending along a second side of the bolster and toward the midpoint of the bolster, the first torsion tube extending through openings in the bolster, and the first torsion tube extending from the second end of the first linkage assembly, through the openings, to the second end of the second linkage assembly.

15. The railroad car truck of claim 14, wherein the first linkage assembly and the second linkage assembly extend parallel to a central axis of the bolster.

16. The railroad car truck of claim 14, wherein the openings in the bolster pass through sidewalls of the bolster, and the openings are positioned between the midpoint of the bolster and the first side frame.

* * * * *